US011982478B2

(12) United States Patent
Miura et al.

(10) Patent No.: US 11,982,478 B2
(45) Date of Patent: May 14, 2024

(54) REFRIGERATION CYCLE APPARATUS

(71) Applicant: DAIKIN INDUSTRIES, LTD., Osaka (JP)

(72) Inventors: Shu Miura, Osaka (JP); Keisuke Nishitani, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 18/514,769

(22) Filed: Nov. 20, 2023

(65) Prior Publication Data

US 2024/0085074 A1 Mar. 14, 2024

Related U.S. Application Data

(63) Continuation of application No. PCT/JP2022/020612, filed on May 18, 2022.

(30) Foreign Application Priority Data

May 21, 2021 (JP) ..... 2021-086498

(51) Int. Cl.
*F25B 49/02* (2006.01)
*F25B 49/00* (2006.01)

(52) U.S. Cl.
CPC ..... *F25B 49/005* (2013.01); *F25B 2500/222* (2013.01)

(58) Field of Classification Search
CPC .... F25B 49/005; F25B 2500/222; F24F 11/36
See application file for complete search history.

(56) References Cited

U.S. PATENT DOCUMENTS

2011/0174059 A1* 7/2011 Yonemori ..... F25B 49/005 73/40
2020/0049384 A1* 2/2020 Asanuma ..... F25B 49/005

FOREIGN PATENT DOCUMENTS

JP 2006-23072 A 1/2006
JP 2008-96051 A 4/2008
(Continued)

OTHER PUBLICATIONS

International Preliminary Report on Patentability and English translation of the Written Opinion of the International Searching Authority for International Application No. PCT/JP2022/020612, dated Nov. 30, 2023.

(Continued)

*Primary Examiner* — Jonathan Bradford
(74) *Attorney, Agent, or Firm* — Birch, Stewart, Kolasch & Birch, LLP

(57) ABSTRACT

An air conditioner includes a refrigerant circuit, sensors that measure an amount representing a state of refrigerant in the refrigerant circuit, and a controller. The controller executes normal operation according to air conditioning load and a first detection operation of detecting refrigerant leakage. The controller adjusts a degree of subcooling at an outlet of the condenser to a first value during normal operation. The controller detects a value related to discharge temperature of the compressor or a value related to degree of superheating at an outlet of the evaporator, based on a sensor measurement result. The controller adjusts degree of subcooling to a second value larger than the first value when executing the first detection operation, and determines that refrigerant is leaking when the value related to discharge temperature of the compressor or the value related to degree of superheating is equal to or larger than a threshold value.

20 Claims, 6 Drawing Sheets

(56) References Cited

FOREIGN PATENT DOCUMENTS

| | | | |
|---|---|---|---|
| JP | 2008-249234 | A | 10/2008 |
| JP | 2012-7848 | A | 1/2012 |
| JP | 2016-50680 | A | 4/2016 |
| JP | 2019-148396 | A | 9/2019 |

OTHER PUBLICATIONS

Decision to Grant a Patent issued in Japanese Patent Application No. 2021-086498, dated Jun. 10, 2022.
International Search Report (PCT/ISA/210) issued in PCT/JP2022/020612, dated Jun. 28, 2022.

* cited by examiner

REFRIGERATION CYCLE APPARATUS

CROSS REFERENCE TO RELATED APPLICATIONS

This application is a Continuation of PCT International Application No. PCT/JP2022/020612, filed on May 18, 2022, which claims priority under 35 U.S.C. § 119(a) to Patent Application No. JP 2021-086498, filed in Japan on May 21, 2021, all of which are hereby expressly incorporated by reference into the present application.

TECHNICAL FIELD

The present disclosure relates to a refrigeration cycle apparatus.

BACKGROUND ART

Conventionally, as in Patent Literature 1 (JP 2006-23072 A), there has been known a refrigeration cycle apparatus that determines presence or absence of refrigerant leakage on the basis of a degree of subcooling when a cooling operation is forcibly executed and a condensation pressure, an evaporation pressure, and a degree of superheating of a refrigeration cycle are controlled to predetermined values.

SUMMARY

The refrigeration cycle apparatus according to a first aspect includes a heat source unit, a utilization unit, and a connection pipe connecting the heat source unit and the utilization unit. The refrigeration cycle apparatus includes a refrigerant circuit through which a refrigerant being configured to circulate, a sensor, and a controller. The refrigerant circuit is formed by connecting, via a refrigerant pipe, a compressor, a condenser, an expansion mechanism, and an evaporator. The sensor is configured to measure an amount representing a state of the refrigerant in the refrigerant circuit. The controller is configured to execute a normal operation according to an air conditioning load and a first detection operation of detecting refrigerant leakage. The controller is configured to adjust a degree of subcooling at an outlet of the condenser to a first value when executing the normal operation. The controller is configured to detect a value related to a discharge temperature of the compressor or a value related to a degree of superheating at an outlet of the evaporator, based on a measurement result of the sensor. The controller is configured to adjust the degree of subcooling to a second value larger than the first value when executing the first detection operation, and determine that the refrigerant is leaking from the refrigerant circuit when the value related to the discharge temperature of the compressor or the value related to the degree of superheating at the outlet of the evaporator is equal to or larger than a threshold value.

DESCRIPTION OF EMBODIMENTS

A refrigeration cycle apparatus of the present disclosure will be described with reference to the drawings.

(1) Overall Configuration

Figure 1:
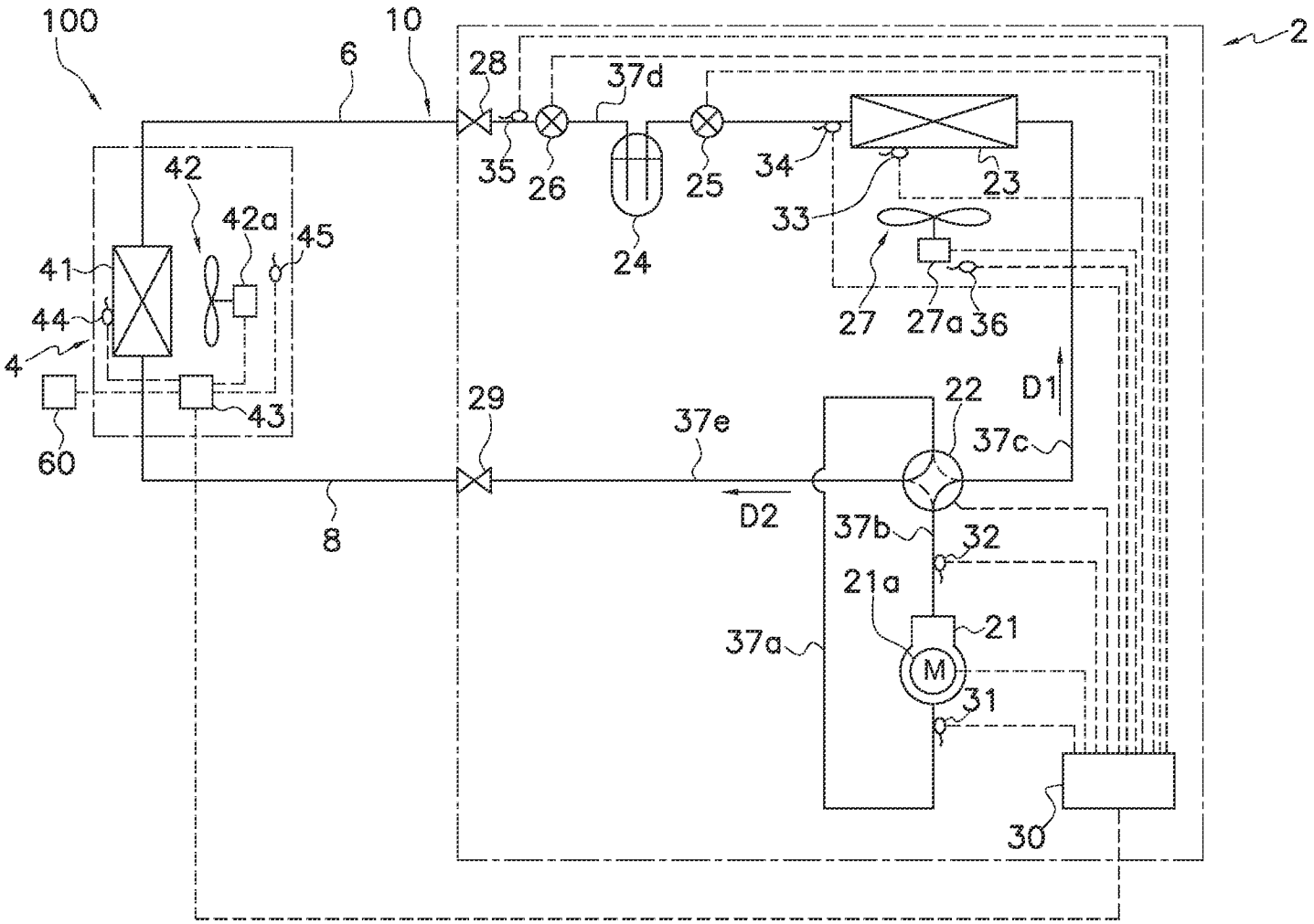
FIG. 1 is a schematic configuration diagram of an air conditioner that is an example of a refrigeration cycle apparatus.
Figure 2:
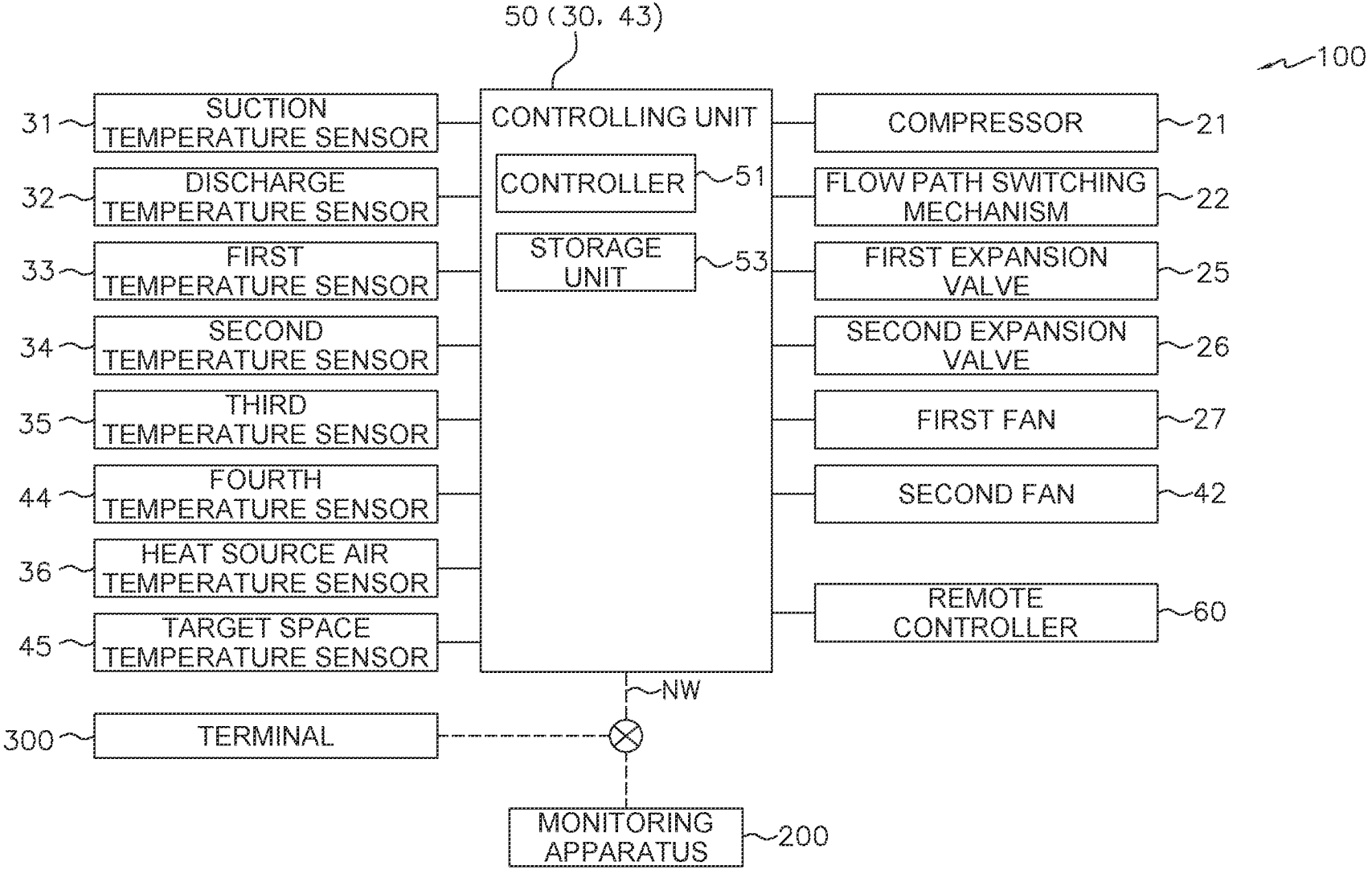
FIG. 2 is a block diagram of the air conditioner and a monitoring apparatus of the air conditioner in FIG. 1.

An air conditioner 100 that is an example of a refrigeration cycle apparatus of the present disclosure and a monitoring apparatus 200 that manages the air conditioner 100 will be described with reference to FIGS. 1 and 2. FIG. 1 is a schematic configuration diagram of the air conditioner 100. FIG. 2 is a block diagram of the air conditioner 100 and the monitoring apparatus 200 of the air conditioner 100.

The air conditioner 100 is an apparatus that performs a vapor compression refrigeration cycle to cool and heat an air conditioning target space. Note that the air conditioner 100 may not be an apparatus that performs both cooling and heating, but may be an apparatus that performs only one of cooling and heating, for example. Note that, when the air conditioner 100 performs only one of cooling and heating, the air conditioner 100 may not include a flow path switching mechanism 22 described later.

Note that the refrigeration cycle apparatus of the present disclosure is not limited to the air conditioner, and may be, for example, an apparatus that performs a vapor compression refrigeration cycle other than the air conditioner. For example, the refrigeration cycle apparatus of the present disclosure may be a refrigeration cycle apparatus for a refrigerator or a freezer used for preservation of food and the like, a hot water supply apparatus, or a floor heating apparatus, for example.

The monitoring apparatus 200 is an apparatus that is owned by a manager or the like (for example, an owner of the air conditioner 100 or a maintenance company entrusted with maintenance of the air conditioner 100) of the air conditioner 100 and monitors a state of the air conditioner 100. The air conditioner 100 reports an operation status and abnormality of the air conditioner 100 to the monitoring apparatus 200 via a network NW such as the Internet. The manager of the air conditioner 100 can acquire the operation status and abnormality of the air conditioner 100 from the monitoring apparatus 200.

The air conditioner 100 mainly includes one heat source unit 2, one utilization unit 4, a liquid refrigerant connection pipe 6, a gas refrigerant connection pipe 8, and a controlling unit 50 (see FIGS. 1 and 2). The liquid refrigerant connection pipe 6 and the gas refrigerant connection pipe 8 are examples of a connection pipe. The liquid refrigerant connection pipe 6 and the gas refrigerant connection pipe 8 connect the heat source unit 2 and the utilization unit 4. The controlling unit 50 controls operations of various devices of the heat source unit 2 and the utilization unit 4. Further, the controlling unit 50 also determines refrigerant leakage from the refrigerant circuit 10 described later.

Note that, although the number of the utilization units 4 of the air conditioner 100 of the present embodiment is one, the air conditioner 100 may have two or more utilization units 4 connected in parallel with each other. Further, although the number of the heat source unit 2 is one in the air conditioner 100, the air conditioner 100 may include two or more heat source units 2.

The heat source unit 2 and the utilization unit 4 are connected via the liquid refrigerant connection pipe 6 and the gas refrigerant connection pipe 8, to constitute a refrigerant circuit 10 through which a refrigerant circulates (see FIG. 1). The refrigerant circuit 10 is formed by connecting a compressor 21, a first heat exchanger 23, a first expansion valve 25, and a second expansion valve 26 of the heat source unit 2, and a second heat exchanger 41 of the utilization unit 4, by a refrigerant pipe (see FIG. 1).

A refrigerant used in the air conditioner 100 is not limited, but is, for example, a hydrofluorocarbon (HFC) refrigerant such as R32. The HFC-based refrigerant is a refrigerant having no ozone layer depletion effect but having a relatively large global warming potential.

Although not limited, the air conditioner 100 of the present embodiment is a chargeless refrigeration cycle apparatus. The chargeless refrigeration cycle apparatus is a type of refrigeration cycle apparatus in which the refrigerant is not additionally charged into the refrigerant circuit 10 at an installation site of the refrigeration cycle apparatus.

More specifically, in the chargeless air conditioner 100 according to the present embodiment, the entire refrigerant to be used in the air conditioner 100 is previously sealed in the heat source unit 2, and the heat source unit 2 is carried into the installation site in a state where a first shutoff valve 28 and a second shutoff valve 29 are closed. Each of the heat source unit 2 and the utilization unit 4 carried into the installation site is installed at a predetermined place. Thereafter, the heat source unit 2 and the utilization unit 4 are connected by the liquid refrigerant connection pipe 6 and the gas refrigerant connection pipe 8. Then, air is removed (vacuumed) from pipes of the utilization unit 4, an inside of the second heat exchanger 41 to be described later, and an inside of the liquid refrigerant connection pipe 6 and the gas refrigerant connection pipe 8, and then the first shutoff valve 28, and the second shutoff valve 29 are opened. In the air conditioner 100, the refrigerant is not additionally charged thereafter. The chargeless refrigeration cycle apparatus can achieve labor saving of installation work since the refrigerant is not additionally charged.

Note that lengths of the liquid refrigerant connection pipe 6 and the gas refrigerant connection pipe 8 of the air conditioner 100 vary depending on a situation of the installation site and the like, even when the heat source units 2 and the utilization units 4 are identical. In a case where lengths of the liquid refrigerant connection pipe 6 and the gas refrigerant connection pipe 8 are long, more refrigerant is required than a case where the lengths of the liquid refrigerant connection pipe 6 and the gas refrigerant connection pipe 8 are short. In the chargeless air conditioner 100, the refrigerant is sealed in the heat source unit 2 in accordance with a predetermined maximum assumed length of the liquid refrigerant connection pipe 6 and the gas refrigerant connection pipe 8 so as not to cause shortage of an amount of refrigerant. Therefore, in a case where the lengths of the liquid refrigerant connection pipe 6 and the gas refrigerant connection pipe 8 are shorter than the maximum assumed length, the refrigerant circuit 10 has a relatively large amount of surplus refrigerant that is not essential for the operation of the air conditioner 100.

The air conditioner 100 of the present embodiment performs a cooling operation and a heating operation as the normal operation according to an air conditioning load. The cooling operation is an operation of causing the first heat exchanger 23 to function as a condenser and the second heat exchanger 41 to function as an evaporator, to cool air in the target space. The heating operation is an operation of causing the first heat exchanger 23 to function as an evaporator and the second heat exchanger 41 to function as a condenser, to warm air in the target space. Further, the air conditioner 100 performs a detection operation of detecting refrigerant leakage. The detection operation will be described later.

(2) Detailed Configuration

The utilization unit 4, the heat source unit 2, the liquid refrigerant connection pipe 6, the gas refrigerant connection pipe 8, and the controlling unit 50 of the air conditioner 100 will be described in detail.

(2-1) Utilization Unit

The utilization unit 4 is installed in an air conditioning target space, a ceiling space of the target space, or the like. For example, the utilization unit 4 is a ceiling-embedded cassette type unit installed on the ceiling. However, the type of the utilization unit 4 is not limited to the ceiling-embedded cassette type, and the utilization unit 4 may be a ceiling-suspended type suspended from a ceiling, a wall-mounted type installed on a wall, a floor-mounted type installed on a floor, a ceiling-embedded duct type in which the entire utilization unit 4 is disposed in a ceiling space, or the like, for example.

As described above, the utilization unit 4 is connected to the heat source unit 2 via the liquid refrigerant connection pipe 6 and the gas refrigerant connection pipe 8, and constitutes a part of the refrigerant circuit 10 together with the heat source unit 2.

The utilization unit 4 includes the second heat exchanger 41 and a second fan 42 (see FIG. 1). The second heat exchanger 41 and the second fan 42 are housed in a casing (not illustrated). The utilization unit 4 includes various sensors. In the present embodiment, the sensors included in the utilization unit 4 include a fourth temperature sensor 44 and a target space temperature sensor 45 (see FIG. 1). The utilization unit 4 includes a second controlling unit 43 that controls an operation of the utilization unit 4 (see FIG. 1).

A main configuration of the utilization unit 4 will be further described below.

(2-1-1) Second Heat Exchanger

The second heat exchanger 41 exchanges heat between a refrigerant flowing inside the second heat exchanger 41 and a medium passing through the second heat exchanger 41. In the present embodiment, the second heat exchanger 41 exchanges heat between the refrigerant flowing inside the second heat exchanger 41 and air in the air conditioning target space.

The second heat exchanger 41 functions as an evaporator during the cooling operation. The second heat exchanger 41 functions as a condenser during the heating operation.

One end of the second heat exchanger 41 is connected to the liquid refrigerant connection pipe 6 via a refrigerant pipe. The other end of the second heat exchanger 41 is connected to the gas refrigerant connection pipe 8 via a refrigerant pipe. During the cooling operation, the refrigerant flows from the liquid refrigerant connection pipe 6 into the second heat exchanger 41, and the refrigerant flowing out of the second heat exchanger 41 flows into the gas refrigerant connection pipe 8. During the heating operation, the refrigerant flows from the gas refrigerant connection pipe 8 into the second heat exchanger 41, and the refrigerant flowing out of the second heat exchanger 41 flows into the liquid refrigerant connection pipe 6.

The second heat exchanger 41 is not limited in terms of a type, and is, for example, a fin-and-tube heat exchanger having a heat transfer tube (not illustrated) and a large number of fins (not illustrated).

(2-1-2) Second Fan

The second fan 42 suctions air in the target space into the casing through an air suction port (not illustrated) of the casing of the utilization unit 4 (not illustrated), and supplies the air to the second heat exchanger 41. The air having exchanged heat with the refrigerant in the second heat exchanger 41 is blown out into the target space through an air blow-out port (not illustrated) in the casing of the utilization unit 4 (not illustrated).

The second fan 42 is, for example, a turbo fan. However, a type of the second fan 42 is not limited to the turbo fan, and may be appropriately selected. The second fan 42 is a fan that is driven by an inverter-controlled motor 42*a*, and has a variable air volume.

(2-1-3) Sensor

The utilization unit 4 includes the fourth temperature sensor 44 and the target space temperature sensor 45, as sensors (see FIG. 1). The fourth temperature sensor 44 is an example of a sensor that measures an amount (a temperature or a pressure) representing a state of a refrigerant in the refrigerant circuit 10. The utilization unit 4 may have a sensor other than the fourth temperature sensor 44 and the target space temperature sensor 45. Further, the utilization unit 4 may have, instead of the fourth temperature sensor 44, a sensor that measures an amount representing a state of a refrigerant at another position.

Although types of the sensors are not limited, the fourth temperature sensor 44 and the target space temperature sensor 45 are, for example, thermistors.

The fourth temperature sensor 44 is provided in the second heat exchanger 41. The fourth temperature sensor 44 measures a temperature of the refrigerant flowing through the second heat exchanger 41.

The target space temperature sensor 45 is provided, for example, at the air suction port of the casing of the utilization unit 4. The target space temperature sensor 45 measures a temperature of air of the target space flowing into the utilization unit 4.

(2-1-4) Second Controlling Unit

The second controlling unit 43 controls operations of individual parts constituting the utilization unit 4.

The second controlling unit 43 has a microcomputer provided to control the utilization unit 4. The microcomputer includes a CPU, a memory including a ROM and a RAM, an I/O, a peripheral circuit, and the like.

The second controlling unit 43 is electrically connected to the second fan 42, the fourth temperature sensor 44, and the target space temperature sensor 45 of the utilization unit 4 so as to be able to exchange control signals and information (including measurement values of the sensors) (see FIG. 1).

In addition, the second controlling unit 43 is connected to a first controlling unit 30 of the heat source unit 2 in a state of being able to exchange control signals and the like with the first controlling unit 30.

Further, the second controlling unit 43 is configured to be able to receive various signals transmitted from a remote controller 60 which is used for operating the air conditioner 100. The various signals transmitted from the remote controller 60 include a signal related to operating and stopping the air conditioner 100, a signal related to an operating mode, and a signal related to setting of a target temperature for the cooling operation and the heating operation.

The second controlling unit 43 and the first controlling unit 30 of the heat source unit 2 cooperatively function as the controlling unit 50 that controls the operation of the air conditioner 100. Functions of the controlling unit 50 will be described later.

(2-2) Heat Source Unit

Although not limited, the heat source unit 2 is installed, for example, on a rooftop of a building where the air conditioner 100 is installed or around the building.

As described above, the heat source unit 2 is connected to the utilization unit 4 via the liquid refrigerant connection pipe 6 and the gas refrigerant connection pipe 8, and constitutes the refrigerant circuit 10 together with the utilization unit 4.

The heat source unit 2 includes the compressor 21, the flow path switching mechanism 22, the first heat exchanger 23, the first expansion valve 25, the second expansion valve 26, a receiver 24, the first shutoff valve 28, the second shutoff valve 29, and a first fan 27 (see FIG. 1). The compressor 21, the flow path switching mechanism 22, the first heat exchanger 23, the first expansion valve 25, the second expansion valve 26, the receiver 24, the first shutoff valve 28, the second shutoff valve 29, and the first fan 27 are housed in a casing (not illustrated) of the heat source unit 2. The heat source unit 2 includes various sensors. In the present embodiment, the sensors included in the heat source unit 2 include a suction temperature sensor 31, a discharge temperature sensor 32, a first temperature sensor 33, a second temperature sensor 34, a third temperature sensor 35, and a heat source air temperature sensor 36 (see FIG. 1). The heat source unit 2 includes the first controlling unit 30 that controls an operation of the heat source unit 2 (see FIG. 1).

The heat source unit 2 includes a suction pipe 37*a*, a discharge pipe 37*b*, a first gas refrigerant pipe 37*c*, a liquid refrigerant pipe 37*d*, and a second gas refrigerant pipe 37*e* (see FIG. 1).

The suction pipe 37*a* connects the flow path switching mechanism 22 and a suction side of the compressor 21. The discharge pipe 37*b* connects a discharge side of the compressor 21 and the flow path switching mechanism 22. The first gas refrigerant pipe 37*c* connects the flow path switching mechanism 22 and a gas side of the first heat exchanger 23. The liquid refrigerant pipe 37*d* connects a liquid side of the first heat exchanger 23 and the first shutoff valve 28. The liquid refrigerant pipe 37*d* is provided with the first expansion valve 25, the second expansion valve 26, and the receiver 24. The second gas refrigerant pipe 37*e* connects the flow path switching mechanism 22 and the second shutoff valve 29.

A main configuration of the heat source unit 2 will be further described below.

(2-2-1) Compressor

The compressor 21 is a device that suctions a low-pressure refrigerant in the refrigeration cycle from the suction pipe 37*a*, compresses the refrigerant by a compression mechanism (not illustrated), and discharges the compressed refrigerant to the discharge pipe 37*b*.

The compressor 21 is not limited in terms of a type, and is, for example, a rotary type or scroll type capacity compressor. A compression mechanism (not illustrated) of the compressor 21 is driven by a motor 21*a* (see FIG. 1). The motor 21*a* is a variable speed motor that is inverter-controlled. A number of rotations of the motor 21*a* is changed within a range of number of rotations between a minimum number of rotations Rmin and a maximum number of rotations Rmax. Note that, the minimum number of rotations Rmin and the maximum number of rotations Rmax may be the minimum number of rotations and the maximum number of rotations that can be achieved by a specification of the motor 21*a*, or may be the minimum number of rotations and the maximum number of rotations appropriately determined by a designer or the like of the air conditioner 100. A capacity of the compressor 21 is controlled by controlling the number of rotations of the motor 21*a*.

(2-2-2) Flow Path Switching Mechanism

The flow path switching mechanism 22 is a mechanism that switches a flow direction of the refrigerant in the refrigerant circuit 10 between a first flow direction D1 and a second flow direction D2. When the flow direction of the refrigerant in the refrigerant circuit 10 is the first flow direction D1, the first heat exchanger 23 functions as a condenser, and the second heat exchanger 41 functions as an evaporator. When the flow direction of the refrigerant in the refrigerant circuit 10 is the second flow direction D2, the first heat exchanger 23 functions as an evaporator and the second heat exchanger 41 functions as a condenser.

The flow path switching mechanism 22 switches the flow direction of the refrigerant to the first flow direction D1 during the cooling operation. For convenience of description, a state of the refrigerant circuit 10 in which the flow direction of the refrigerant is switched to the first flow direction D1 is referred to as a first state. The flow path switching mechanism 22 switches the flow direction of the refrigerant to the second flow direction D2 during the heating operation. For convenience of description, a state of the refrigerant circuit 10 in which the flow direction of the refrigerant is switched to the second flow direction D2 is referred to as a second state.

The flow path switching mechanism 22 will be described more specifically.

When the refrigerant circuit 10 is set to the first state, the flow path switching mechanism 22 causes the suction pipe 37*a* to communicate with the second gas refrigerant pipe 37*e*, and causes the discharge pipe 37*b* to communicate with the first gas refrigerant pipe 37*c* (see a solid line in the flow path switching mechanism 22 in FIG. 1). When the flow direction of the refrigerant in the refrigerant circuit 10 is the first flow direction D1, the refrigerant discharged from the compressor 21 flows through the refrigerant circuit 10 in the order of the first heat exchanger 23 as a condenser, the first expansion valve 25, the second expansion valve 26, and the second heat exchanger 41 as an evaporator, and returns to the compressor 21.

When the refrigerant circuit 10 is set to the second state, the flow path switching mechanism 22 causes the suction pipe 37*a* to communicate with the first gas refrigerant pipe 37*c*, and causes the discharge pipe 37*b* to communicate with the second gas refrigerant pipe 37*e* (see a broken line in the flow path switching mechanism 22 in FIG. 1). When the flow direction of the refrigerant in the refrigerant circuit 10 is the second flow direction D2, the refrigerant discharged from the compressor 21 flows through the refrigerant circuit 10 in the order of the second heat exchanger 41 as a condenser, the second expansion valve 26, the first expansion valve 25, and the first heat exchanger 23 as an evaporator, and returns to the compressor 21.

The flow path switching mechanism 22 according to the present embodiment is configured as a four-way switching valve. However, the flow path switching mechanism 22 is not limited to the four-way switching valve. The flow path switching mechanism 22 may be configured to achieve switching of the flow direction of the refrigerant described above, by combining a plurality of electromagnetic valves and refrigerant pipes, for example.

(2-2-3) First Heat Exchanger

The first heat exchanger 23 exchanges heat between a refrigerant flowing inside the first heat exchanger 23 and a medium passing through the first heat exchanger 23. In the present embodiment, the first heat exchanger 23 exchanges heat between the refrigerant flowing inside the first heat exchanger 23 and air (heat source air) around the heat source unit 2.

The first heat exchanger 23 functions as a condenser during the cooling operation. The first heat exchanger 23 functions as an evaporator during the heating operation.

One end of the first heat exchanger 23 is connected to the liquid refrigerant pipe 37*d*. The other end of the first heat exchanger 23 is connected to the first gas refrigerant pipe 37*c*. During the cooling operation, the refrigerant flows from the first gas refrigerant pipe 37*c* into the first heat exchanger 23, and the refrigerant flowing out of the first heat exchanger 23 flows into the liquid refrigerant pipe 37*d*. During the heating operation, the refrigerant flows from the liquid refrigerant pipe 37*d* into the first heat exchanger 23, and the refrigerant flowing out of the first heat exchanger 23 flows into the first gas refrigerant pipe 37*c*.

The first heat exchanger 23 is not limited in terms of a type, and is, for example, a fin-and-tube heat exchanger having a heat transfer tube (not illustrated) and a large number of fins (not illustrated).

(2-2-4) First Expansion Valve and Second Expansion Valve

The first expansion valve 25 and the second expansion valve 26 are examples of an expansion mechanism. The first expansion valve 25 and the second expansion valve 26 are mechanisms for adjusting a pressure and a flow rate of the refrigerant flowing through the liquid refrigerant pipe 37*d*. The first expansion valve 25 and the second expansion valve 26 are, for example, electronic expansion valves whose opening degree is variable.

The first expansion valve 25 is disposed between the first heat exchanger 23 and the receiver 24, in the liquid refrigerant pipe 37*d*. The second expansion valve 26 is disposed between the receiver 24 and the first shutoff valve 28, in the liquid refrigerant pipe 37*d*.

During the cooling operation, the first expansion valve 25 is disposed between the condenser and the receiver 24, and the second expansion valve 26 is disposed between the receiver 24 and the evaporator. During the heating operation, the second expansion valve 26 is disposed between the condenser and the receiver 24, and the first expansion valve 25 is disposed between the receiver 24 and the evaporator.

(2-2-5) Receiver

The receiver 24 is a container capable of storing a refrigerant.

The receiver 24 is disposed between the first heat exchanger 23 and the second heat exchanger 41, in the refrigerant circuit 10. In other words, the receiver 24 is disposed between the condenser and the evaporator, in the refrigerant circuit 10. The receiver 24 is disposed between the first expansion valve 25 and the second expansion valve 26, in the liquid refrigerant pipe 37*d*.

(2-2-6) First Shutoff Valve and Second Shutoff Valve

The first shutoff valve 28 is a valve provided at a connection portion between the liquid refrigerant pipe 37*d* and the liquid refrigerant connection pipe 6. The second shutoff valve 29 is a valve provided at a connection portion between the second gas refrigerant pipe 37*e* and the gas refrigerant connection pipe 8. The first shutoff valve 28 and the second shutoff valve 29 are, for example, manually operated valves. During the operation of the air conditioner 100, the first shutoff valve 28 and the second shutoff valve 29 are open.

(2-2-7) First Fan

The first fan 27 suctions heat source air outside the heat source unit 2 into the casing via an air suction port (not illustrated) of the casing of the heat source unit 2 (not illustrated), and supplies the air to the first heat exchanger 23. The air having exchanged heat with the refrigerant in the first heat exchanger 23 is blown out through an air blow-out port (not illustrated) in the casing of the heat source unit 2 (not illustrated).

The first fan 27 is, for example, a propeller fan. However, a type of the first fan 27 is not limited to the propeller fan, and may be appropriately selected. The first fan 27 is a fan that is driven by an inverter-controlled motor 27*a*, and has a variable air volume.

(2-2-8) Sensor

The heat source unit 2 has, as sensors, the suction temperature sensor 31, the discharge temperature sensor 32, the first temperature sensor 33, the second temperature sensor 34, the third temperature sensor 35, and the heat source air temperature sensor 36 (see FIG. 1). The suction temperature sensor 31, the discharge temperature sensor 32, the first temperature sensor 33, the second temperature sensor 34, and the third temperature sensor 35 are examples of a sensor that measures an amount (a temperature or a pressure) representing a state of a refrigerant in the refrigerant circuit 10. The heat source unit 2 may have a sensor other than the suction temperature sensor 31, the discharge temperature sensor 32, the first temperature sensor 33, the second temperature sensor 34, the third temperature sensor 35, and the heat source air temperature sensor 36. Further, the heat source unit 2 may have only some of the suction temperature sensor 31, the discharge temperature sensor 32, the first temperature sensor 33, the second temperature sensor 34, the third temperature sensor 35, and the heat source air temperature sensor 36.

Although a type of the sensor is not limited, the suction temperature sensor 31, the discharge temperature sensor 32, the first temperature sensor 33, the second temperature sensor 34, the third temperature sensor 35, and the heat source air temperature sensor 36 are, for example, thermistors.

The suction temperature sensor 31 is provided in the suction pipe 37*a*. The suction temperature sensor 31 measures a temperature (suction temperature) of the refrigerant suctioned into the compressor 21.

The discharge temperature sensor 32 is provided in the discharge pipe 37*b*. The discharge temperature sensor 32 measures a temperature (discharge temperature) of the refrigerant discharged from the compressor 21.

The first temperature sensor 33 is provided in the first heat exchanger 23. The first temperature sensor 33 measures a temperature of the refrigerant flowing in the first heat exchanger 23.

The second temperature sensor 34 is provided between the first heat exchanger 23 and the first expansion valve 25. The second temperature sensor 34 measures a temperature of the refrigerant flowing between the first heat exchanger 23 and the first expansion valve 25.

The third temperature sensor 35 is provided between the second expansion valve 26 and the second heat exchanger 41. The third temperature sensor 35 measures a temperature of the refrigerant flowing between the second expansion valve 26 and the second heat exchanger 41.

The heat source air temperature sensor 36 measures a temperature of heat source air that exchanges heat with the refrigerant in the first heat exchanger 23.

(2-2-9) First Controlling Unit

The first controlling unit 30 controls operations of individual parts constituting the heat source unit 2.

The first controlling unit 30 includes a microcomputer provided to control the heat source unit 2. The microcomputer includes a CPU, a memory including a ROM and a RAM, an I/O, a peripheral circuit, and the like.

The first controlling unit 30 is electrically connected to the compressor 21, the flow path switching mechanism 22, the first expansion valve 25, the second expansion valve 26, the first fan 27, the suction temperature sensor 31, the discharge temperature sensor 32, the first temperature sensor 33, the second temperature sensor 34, the third temperature sensor 35, and the heat source air temperature sensor 36 of the heat source unit 2, so as to be able to exchange control signals and information (including measurement values of sensors) (see FIG. 1).

In addition, the first controlling unit 30 is connected to the second controlling unit 43 of the utilization unit 4 in a state of being able to exchange control signals and the like with the second controlling unit 43.

The first controlling unit 30 and the second controlling unit 43 of the utilization unit 4 cooperatively function as the controlling unit 50 that controls the operation of the air conditioner 100. Functions of the controlling unit 50 will be described later.

(2-3) Refrigerant Connection Pipe

The air conditioner 100 includes the liquid refrigerant connection pipe 6 and the gas refrigerant connection pipe 8 as an example of a connection pipe.

The liquid refrigerant connection pipe 6 and the gas refrigerant connection pipe 8 are pipes constructed at an installation place of the air conditioner 100 when the air conditioner 100 is installed. Lengths of the liquid refrigerant connection pipe 6 and the gas refrigerant connection pipe 8 are determined in accordance with installation conditions (a distance between the location of the heat source unit 2 and location of the utilization unit 4, a piping path, and the like).

(2-4) Controlling Unit

The controlling unit 50 is configured by communicably connecting the first controlling unit 30 of the heat source unit 2 and the second controlling unit 43 of the utilization unit 4. The controlling unit 50 controls the entire operation of the air conditioner 100 by CPUs of microcomputers of the first controlling unit 30 and the second controlling unit 43 executing a program stored in the memory.

Note that the controlling unit 50 of the present embodiment is merely an example. The controlling unit may implement a function similar to the function exhibited by the controlling unit 50 of the present embodiment by hardware such as a logic circuit or a combination of hardware and software.

In addition, here, the first controlling unit 30 and the second controlling unit 43 constitute the controlling unit 50, but the present disclosure is not limited thereto. For example, in addition to the first controlling unit 30 and the second controlling unit 43, or in place of the first controlling unit 30 and the second controlling unit 43, the air conditioner 100 may have a control device that is provided separately from the heat source unit 2 and the utilization unit 4 and implements some or all of the functions of the controlling unit 50 described below. Further, some or all of the functions of the controlling unit 50 described below may be implemented by a server or the like installed in a place different from the air conditioner 100.

As illustrated in FIG. 2, the controlling unit 50 is electrically connected to various devices of the heat source unit 2 and the utilization unit 4, including the compressor 21, the flow path switching mechanism 22, the first expansion valve 25, the second expansion valve 26, the first fan 27, and the second fan 42. Further, as illustrated in FIG. 2, the controlling unit 50 is electrically connected to the suction temperature sensor 31, the discharge temperature sensor 32, the first temperature sensor 33, the second temperature sensor 34, the third temperature sensor 35, the fourth temperature sensor 44, the heat source air temperature sensor 36, and the target space temperature sensor 45.

Further, the controlling unit 50 is communicably connected to the monitoring apparatus 200 via the network NW such as the Internet. Note that, although not illustrated here, the monitoring apparatus 200 may be connected not only to the air conditioner 100 but also to a plurality of refrigeration cycle apparatuses. The monitoring apparatus 200 monitors a state and the like of the refrigeration cycle apparatus including the air conditioner 100, and accumulates various types of information transmitted from the refrigeration cycle apparatus. For example, the controlling unit 50 transmits a refrigerant leakage determination result of a controller 51 described later to the monitoring apparatus 200, and the monitoring apparatus 200 stores the acquired refrigerant leakage determination result as the refrigerant leakage determination result of the air conditioner 100. On the basis of the refrigerant leakage determination result transmitted by the controlling unit 50, the manager of the air conditioner 100 who uses the monitoring apparatus 200 can grasp whether or not a refrigerant is leaking from the refrigerant circuit 10 of the air conditioner 100.

Furthermore, the controlling unit 50 is communicably connected to a terminal 300 via the network NW such as the Internet. The terminal 300 is a device used by a worker to input various commands and various types of information to the controlling unit 50 at a time of installation work of the air conditioner 100 and the like. The terminal 300 is, for example, a smartphone or a tablet computer. Note that the controlling unit 50 and the terminal 300 may be configured to be connectable by a communication cable instead of via the network NW.

The controlling unit 50 functions as the controller 51 having functions described below, by the CPUs of the microcomputers of the first controlling unit 30 and the second controlling unit 43 executing a program stored in the memory. Furthermore, the controlling unit 50 includes a storage unit 53 that stores various types of information.

The controller 51 has the following functions, for example.

<Control of Operation of Air Conditioner>

The controller 51 controls operations of individual parts of the heat source unit 2 and the utilization unit 4 when the air conditioner 100 performs the cooling operation, the heating operation, and the detection operation. How the controller 51 controls the air conditioner 100 during the cooling operation, the heating operation, and the detection operation will be described later.

<Reception of Command and Information>

The controller 51 receives various commands and various types of information input from the terminal 300. The information received by the controller 51 includes information regarding lengths of the liquid refrigerant connection pipe 6 and the gas refrigerant connection pipe 8. Hereinafter, for simplification of description, the lengths of the liquid refrigerant connection pipe 6 and the gas refrigerant connection pipe 8 may be referred to as a connection pipe length. Further, in order to simplify the description, information regarding the lengths of the liquid refrigerant connection pipe 6 and the gas refrigerant connection pipe 8 received by the controller 51 may be referred to as connection pipe length information.

The connection pipe length information is, for example, length values of the liquid refrigerant connection pipe 6 and the gas refrigerant connection pipe 8. Further, the connection pipe length information may indicate, for example, a length range (for example, 10 to 15 m) to which the lengths of the liquid refrigerant connection pipe 6 and the gas refrigerant connection pipe 8 belong. The connection pipe length information received by the controller 51 is stored in the storage unit 53.

Note that, here, the controller 51 receives the connection pipe length information from the terminal 300, but the present disclosure is not limited thereto. For example, in a case where the remote controller 60 has a function of receiving an input of the connection pipe length information, the controller 51 may receive the connection pipe length information from the remote controller 60.

<Detection of Value Related to Discharge Temperature of Compressor, or Value Related to Degree of Superheating at Outlet of Evaporator>

The controller 51 detects a value related to a discharge temperature of the compressor 21 or a value related to a degree of superheating at the outlet of the evaporator, on the basis of measurement results of the sensors of the air conditioner 100. Note that, here, the term "detecting a value" includes not only a meaning of acquiring a measurement result of a single sensor as a value, but also a meaning of calculating a value on the basis of measurement results of a plurality of sensors.

For example, when the first heat exchanger 23 functions as a condenser, the controller 51 detects (acquires) a measurement value of the discharge temperature sensor 32, as the value related to a discharge temperature of the compressor 21. Further, the controller 51 may detect a degree of discharge superheating as the value related to a discharge temperature of the compressor 21. Specifically, when acquiring the degree of discharge superheating, the controller 51 subtracts a measurement value of the first temperature sensor 33 from a measurement value of the discharge temperature sensor 32, to detect (calculate) the degree of discharge superheating.

Further, for example, when the first heat exchanger 23 functions as a condenser, the controller 51 subtracts a measurement value of the fourth temperature sensor 44 from a measurement value of the suction temperature sensor 31, to detect (calculate) the degree of superheating (degree of suction superheating) at the outlet of the evaporator.

For example, when the second heat exchanger 41 functions as a condenser, the controller 51 detects (acquires) a measurement value of the discharge temperature sensor 32, as the value related to a discharge temperature of the compressor 21. The controller 51 may detect a degree of discharge superheating as the value related to a discharge temperature of the compressor 21. Specifically, when acquiring the degree of discharge superheating, the controller 51 subtracts a measurement value of the fourth temperature sensor 44 from a measurement value of the discharge temperature sensor 32, to detect (calculate) the degree of discharge superheating.

Further, for example, in a case where the second heat exchanger 41 functions as a condenser, the controller 51 subtracts a measurement value of the first temperature sensor 33 from a measurement value of the suction temperature sensor 31, to detect (calculate) the degree of superheating (degree of suction superheating) at the outlet of the evaporator.

Note that the methods for detecting the discharge temperature, the degree of discharge superheating, and the degree of suction superheating described here are merely an example. For example, a temperature sensor and a pressure sensor other than those exemplified in the refrigerant circuit 10 may be provided, and the controller 51 may detect the discharge temperature, the degree of discharge superheating, and the degree of suction superheating on the basis of measurement results of these sensors.

<Determination of Refrigerant Leakage>

The controller 51 determines whether or not a refrigerant is leaking from the refrigerant circuit 10.

The controller 51 determines whether or not the refrigerant is leaking from the refrigerant circuit 10, for example, on the basis of a comparison result between a predetermined first threshold value and a discharge temperature (or a degree of discharge superheating) detected on the basis of measurement results obtained by the sensors during the detection operation of the air conditioner 100. Specifically, the controller 51 determines that the refrigerant is leaking from the refrigerant circuit 10 when the discharge temperature (or the degree of discharge superheating) is equal to or higher than the first threshold value.

Alternatively, for example, the controller 51 determines whether or not the refrigerant is leaking from the refrigerant circuit 10 on the basis of a comparison result between a predetermined second threshold value and a degree of suction superheating detected on the basis of measurement values of the sensors during the detection operation of the air conditioner 100. Specifically, the controller 51 determines that the refrigerant is leaking from the refrigerant circuit 10 when the degree of suction superheating is equal to or larger than the second threshold value.

Further, the controller 51 may determine whether or not the refrigerant is leaking from the refrigerant circuit 10 on the basis of both the discharge temperature (or the degree of discharge superheating) and the degree of suction superheating. For example, the controller 51 may determine that the refrigerant is leaking from the refrigerant circuit 10 when the discharge temperature (or the degree of discharge superheating) is equal to or higher than the first threshold value and the degree of suction superheating is equal to or higher than the second threshold value.

Note that, the first threshold value and the second threshold value for use in the determination by the controller 51 are preferably determined in accordance with the lengths of the liquid refrigerant connection pipe 6 and the gas refrigerant connection pipe 8 (connection pipe length). The reason will be described.

In this explanation, a case is assumed in which the same amount of refrigerant is sealed in the refrigerant circuits 10 of the two air conditioners 100 having the same specifications of the heat source unit 2 and the utilization unit 4. However, in this explanation, the connection pipe length of one (referred to as an air conditioner A) of the two air conditioners 100 is assumed to be shorter than the connection pipe length of the other (referred to as an air conditioner B). In other words, an amount of a charged refrigerant per unit internal volume of the refrigerant circuit 10 of the air conditioner A is larger than an amount of a charged refrigerant per unit internal volume of the refrigerant circuit 10 of the air conditioner B. Note that, the internal volume of the refrigerant circuit 10 is substantially equal to a sum of internal volumes of the first heat exchanger 23 and the second heat exchanger 41, an internal volume of the receiver 24, and internal volumes of the liquid refrigerant connection pipe 6 and the gas refrigerant connection pipe 8.

In this case, the air conditioner A has a relatively larger amount of surplus refrigerant than the air conditioner B. Therefore, if the detection operation is performed with the same operation content, the degree of discharge superheating of the air conditioner A tends to be smaller than the degree of discharge superheating of the air conditioner B. Further, if the detection operation is performed with the same operation content, the degree of suction superheating of the air conditioner A tends to be smaller than the degree of suction superheating of the air conditioner B. Therefore, when the same first threshold value and second threshold value are used in the air conditioner A and the air conditioner B, there is a possibility that a state without refrigerant leakage is determined as a state with refrigerant leakage, or a state with refrigerant leakage is determined as a state without refrigerant leakage. On the other hand, by changing the first threshold value and the second threshold value according to the connection pipe length, it is possible to accurately determine the refrigerant leakage.

Figure 4:
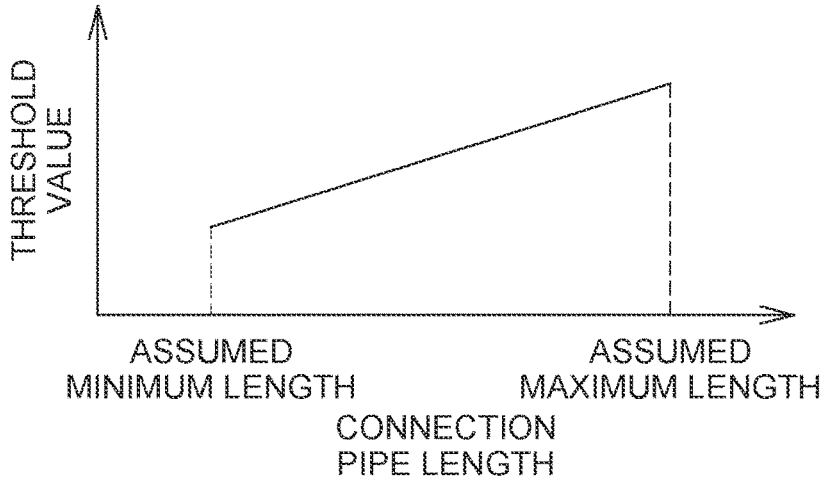
FIG. 4 is a graph conceptually illustrating an example of a relationship between a connection pipe length and a threshold value for use in determination of refrigerant leakage.
Figure 5:
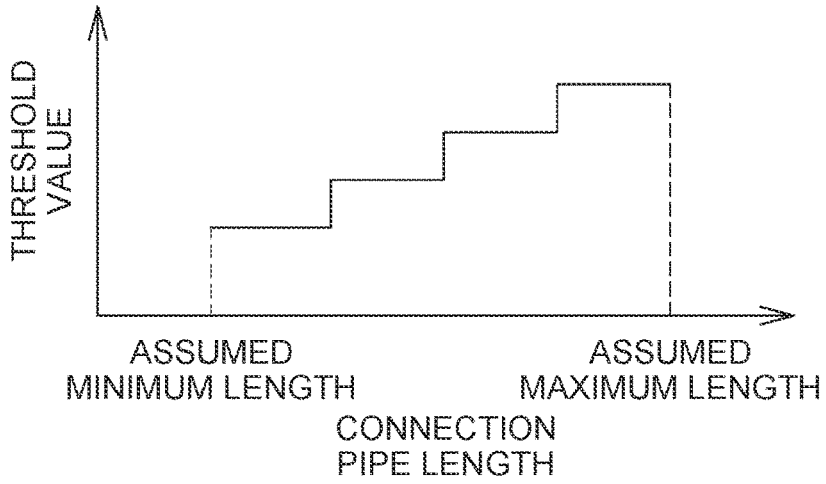
FIG. 5 is a graph conceptually illustrating another example of a relationship between a connection pipe length and a threshold value for use in determination of refrigerant leakage.

For the above reason, a smaller value is preferably used as the first threshold value and the second threshold value as the connection pipe length is shorter. Note that, as illustrated in FIG. 4, the first threshold value and the second threshold value may be continuously changed in accordance with a change in the connection pipe length. Further, as illustrated in FIG. 5, the first threshold value and the second threshold value may be changed stepwise for each range of the connection pipe length.

The controller 51 determines the first threshold value and the second threshold value for use in the determination of refrigerant leakage by the following method, for example.

The storage unit 53 stores a connection pipe length or a length range of the connection pipe length, and the first threshold value and the second threshold value corresponding to the connection pipe length or the length range of the connection pipe length, in association with each other. The controller 51 calls, from the storage unit 53, the first threshold value and the second threshold value corresponding to the connection pipe length or the length range of the connection pipe length corresponding to the connection pipe length information stored in the storage unit 53, to determine the first threshold value and the second threshold value for use in the determination of refrigerant leakage.

The storage unit 53 may store a calculation formula for calculating the first threshold value and the second threshold value from the connection pipe length. The controller 51 may determine the first threshold value and the second threshold value for use in the determination of refrigerant leakage, by substituting the connection pipe length as the connection pipe length information stored in the storage unit 53 into the calculation formula stored in the storage unit 53.

Note that, the first threshold value and the second threshold value corresponding to the connection pipe length or the length range of the connection pipe length, and the calculation formula for calculating the first threshold value and the second threshold value from the connection pipe length may be determined by, for example, theoretical calculation, an experiment using a test machine, or a simulation on a computer.

(3) Operation of Air Conditioner

An operation of the air conditioner 100 during the cooling operation, the heating operation, and the detection operation will be described.

(3-1) Cooling Operation

The cooling operation executed by the controller 51 will be described. The cooling operation is an example of a normal operation according to an air conditioning load.

When performing the cooling operation, the controller 51 brings the refrigerant circuit 10 into the first state, and activates the compressor 21, the first fan 27, and the second fan 42. As a result of bringing the refrigerant circuit 10 into the first state and operating the compressor 21, the refrigerant circulates in the refrigerant circuit 10 as follows.

A low-pressure gas refrigerant in the refrigerant circuit 10 is suctioned into the compressor 21, and compressed to become a high-pressure gas refrigerant. The high-pressure gas refrigerant discharged from the compressor 21 is sent to the first heat exchanger 23 functioning as a condenser. The high-pressure gas refrigerant having flowed into the first heat exchanger 23 exchanges heat with heat source air supplied by the first fan 27 to the first heat exchanger 23, to be cooled and condensed to become a high-pressure liquid refrigerant. The high-pressure liquid refrigerant is sent to the first expansion valve 25 and decompressed in the first expansion valve 25. The refrigerant decompressed in the first expansion valve 25 is temporarily stored in the receiver 24, then sent to the second expansion valve 26, and decompressed in the second expansion valve 26. The refrigerant decompressed at the second expansion valve 26 is sent to the utilization unit 4 via the liquid refrigerant connection pipe 6. The refrigerant sent to the utilization unit 4 is sent to the second heat exchanger 41 functioning as an evaporator. In the second heat exchanger 41, the low-pressure refrigerant having flowed into the second heat exchanger 41 exchanges heat with air of a target space supplied by the second fan 42, and heated and evaporated to become a low-pressure gas refrigerant. At this time, the air cooled by heat exchange with the refrigerant in the second heat exchanger 41 is blown out into the target space through the air blow-out port of the casing (not illustrated) of the utilization unit 4. The low-pressure gas refrigerant evaporated in the second heat exchanger 41 is suctioned into the compressor 21 via the gas refrigerant connection pipe 8, the second gas refrigerant pipe 37*e*, and the suction pipe 37*a*.

Note that, although not limited, during the cooling operation, the controller 51 controls the compressor 21, the first expansion valve 25, and the second expansion valve 26 as follows.

The controller 51 controls an opening degree of the first expansion valve 25 such that a degree of subcooling is adjusted to a predetermined first target value. The degree of subcooling is calculated, for example, by subtracting a measurement value of the second temperature sensor 34 from a measurement value of the first temperature sensor 33. Further, the controller 51 also controls a number of rotations of the compressor 21 such that an evaporation temperature at the second heat exchanger 41 (a measurement value of the fourth temperature sensor 44) is adjusted to a target evaporation temperature. The target evaporation temperature is determined on the basis of a temperature difference between a temperature of the target space measured by the target space temperature sensor 45 and a set temperature for the cooling operation. Further, the controller 51 also controls an opening degree of the second expansion valve 26 such that a degree of dryness of the refrigerant suctioned by the compressor 21 is adjusted to a predetermined target value.

(3-2) Heating Operation

The heating operation executed by the controller 51 will be described. The heating operation is an example of a normal operation according to an air conditioning load.

When performing the heating operation, the controller 51 brings the refrigerant circuit 10 into the second state, and activates the compressor 21, the first fan 27, and the second fan 42. As a result of bringing the refrigerant circuit 10 into the second state and operating the compressor 21, the refrigerant circulates in the refrigerant circuit 10 as follows.

A low-pressure gas refrigerant in the refrigerant circuit 10 is suctioned into the compressor 21, and compressed to become a high-pressure gas refrigerant. The high-pressure gas refrigerant discharged from the compressor 21 is sent to the second heat exchanger 41 functioning as a condenser. In the second heat exchanger 41, the high-pressure gas refrigerant having flowed into the second heat exchanger 41 exchanges heat with air of the target space supplied by the second fan 42, to be cooled and condensed to become a high-pressure liquid refrigerant. At this time, the air heated by heat exchange with the refrigerant in the second heat exchanger 41 is blown out into the target space through the air blow-out port of the casing (not illustrated) of the utilization unit 4. The high-pressure liquid refrigerant flowing out of the second heat exchanger 41 is sent to the heat source unit 2 via the liquid refrigerant connection pipe 6. The refrigerant having flowed into the heat source unit 2 is sent to the second expansion valve 26, and decompressed in the second expansion valve 26. The refrigerant decompressed in the second expansion valve 26 is temporarily stored in the receiver 24, then sent to the first expansion valve 25, and decompressed in the first expansion valve 25. The refrigerant decompressed in the first expansion valve 25 is sent to the first heat exchanger 23 functioning as an evaporator. In the first heat exchanger 23, the low-pressure refrigerant having flowed into the first heat exchanger 23 exchanges heat with heat source air supplied by the first fan 27, and is heated and evaporated to become a low-pressure gas refrigerant. The low-pressure gas refrigerant evaporated in the first heat exchanger 23 is suctioned into the compressor 21 via the first gas refrigerant pipe 37*c* and the suction pipe 37*a*.

Note that, although not limited, during the heating operation, the controller 51 controls the compressor 21, the first expansion valve 25, and the second expansion valve 26 as follows.

The controller 51 controls an opening degree of the second expansion valve 26 such that a degree of subcooling is adjusted to a predetermined second target value. The degree of subcooling is calculated, for example, by subtracting a measurement value of the third temperature sensor 35 from a measurement value of the fourth temperature sensor 44. Further, the controller 51 also controls a number of rotations of the compressor 21 such that a condensation temperature at the second heat exchanger 41 (a measurement value of the fourth temperature sensor 44) is adjusted to a target condensation temperature. The target condensation temperature is determined on the basis of a temperature difference between a temperature of the target space measured by the target space temperature sensor 45 and a set temperature for the heating operation. Further, the controller 51 also controls an opening degree of the first expansion valve 25 such that a degree of dryness of the refrigerant suctioned by the compressor 21 is adjusted to a predetermined target value.

(3-3) Detection Operation

A detection operation executed by the controller 51 at a time of detecting refrigerant leakage will be described.

For example, the controller 51 executes the detection operation at a predetermined timing. For example, the controller 51 executes the detection operation once a day.

The controller 51 may execute the detection operation in response to an instruction to the air conditioner 100 via the remote controller 60 or the terminal 300.

During the detection operation, the controller 51 may set the state of the refrigerant circuit 10 to the first state or the second state. For example, the controller 51 controls an operation of the flow path switching mechanism 22 to set the state of the refrigerant circuit 10 to a state same as that in the most recently performed cooling operation or heating operation. Alternatively, the controller 51 may constantly set the state of the refrigerant circuit 10 to the first state during the detection operation.

A flow of the refrigerant in the refrigerant circuit 10 when the state of the refrigerant circuit 10 is set to the first state and the second state has already been described in the description of the cooling operation and the heating operation, and thus the description thereof will be omitted here.

Figure 3:
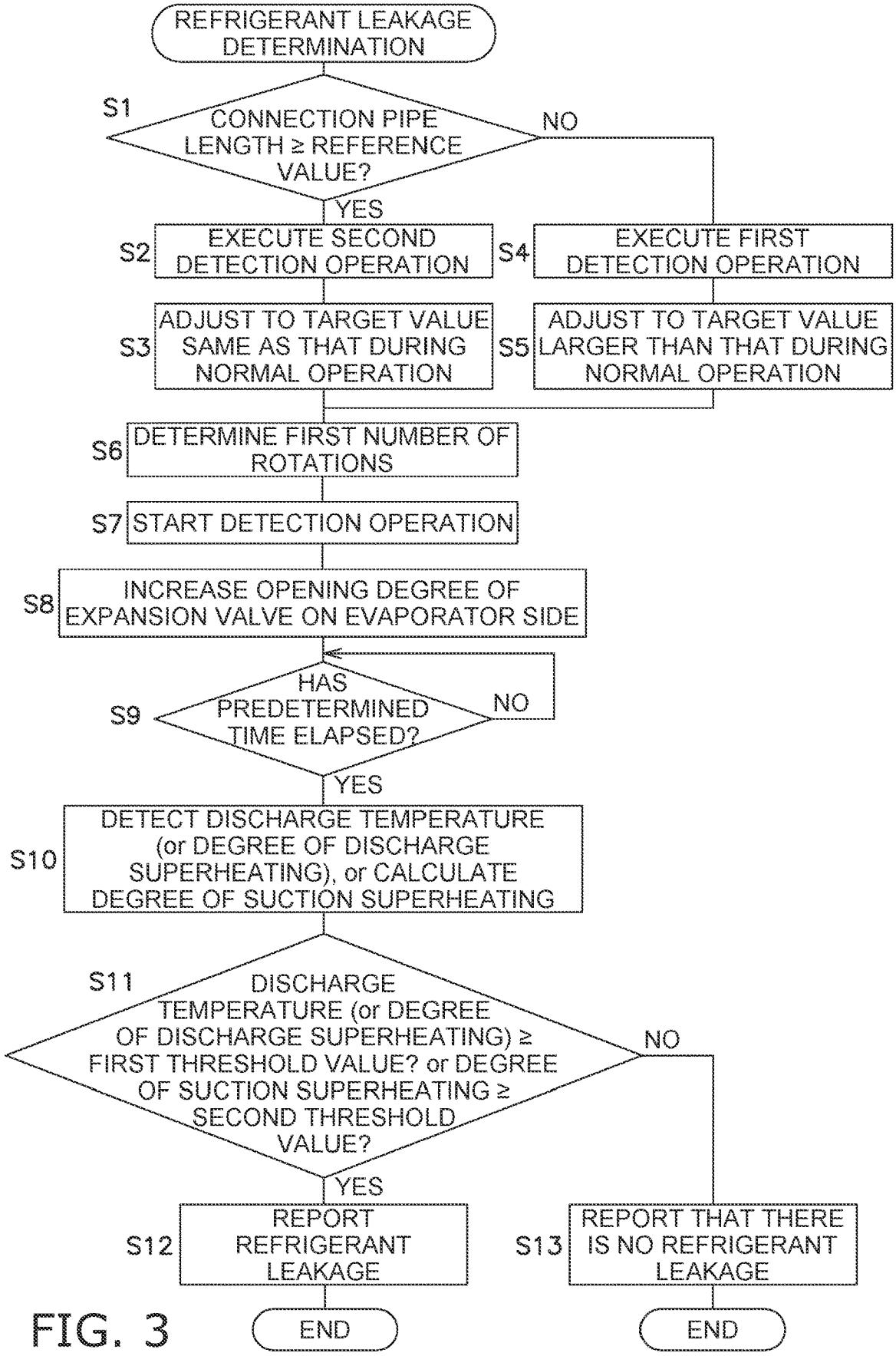
FIG. 3 is a flowchart of refrigerant leakage determination processing (including an operation control content during a detection operation) of the air conditioner of FIG. 1.

Refrigerant leakage determination processing (including an operation content of the detection operation) performed by the controller 51 will be described with reference to FIG. 3. FIG. 3 is a flowchart of the refrigerant leakage determination processing (including an operation control content during the detection operation) of the air conditioner 100.

When it is determined that the refrigerant leakage determination processing is to be executed, the controller 51 determines whether or not lengths of the liquid refrigerant connection pipe 6 and the gas refrigerant connection pipe 8 (connection pipe length) are longer than a predetermined length (reference value) on the basis of the connection pipe length information (the connection pipe length information received by the controller 51) stored in the storage unit 53 (step S1).

When the connection pipe length is equal to or longer than the predetermined reference value (Yes in step S1), the controller 51 determines to execute the second detection operation (step S2). When the connection pipe length is shorter than the predetermined reference value (No in step S1), the controller 51 determines to execute the first detection operation (step S4).

As will be described later, when executing the detection operation, the controller 51 of the controlling unit 50 adjusts a degree of subcooling at an outlet of the condenser (hereinafter, may be simply referred to as a degree of subcooling) to a predetermined target value. A difference between the first detection operation and the second detection operation is a difference in a target value of the degree of subcooling used when the controller 51 executes the detection operation.

When performing the second detection operation, the controller 51 determines to adjust the degree of subcooling to the same target value as that during the normal operation (step S3). Specifically, when executing the second detection operation with the refrigerant circuit 10 brought into the first state, the controller 51 determines to adjust the degree of subcooling to the first target value same as that during the cooling operation. Further, when executing the second detection operation with the refrigerant circuit 10 brought into the second state, the controller 51 determines to adjust the degree of subcooling to the second target value same as that during the heating operation.

When performing the first detection operation, the controller 51 determines to adjust the degree of subcooling to a value larger than the target value during the normal operation (step S5). Specifically, when executing the first detection operation with the refrigerant circuit 10 brought into the first state, the controller 51 determines to adjust the degree of subcooling to a third target value larger than the first target value during the cooling operation. Here, the first target value is an example of a first value in the claims, and the third target value is an example of a second value in the claims. Further, when executing the first detection operation with the refrigerant circuit 10 brought into the second state, the controller 51 determines to adjust the degree of subcooling to a fourth target value larger than the second target value during the heating operation. Here, the second target value is an example of the first value in the claims, and the fourth target value is an example of the second value in the claims.

The following is the reason why the degree of subcooling is adjusted to the value larger than the target value during the normal operation when the first detection operation is performed, in other words, when the connection pipe length is shorter than the reference value.

Similarly to the explanation in the (2-4-4) refrigerant leakage determination unit, an air conditioner A having a short connection pipe length and an air conditioner B having a long connection pipe length are assumed, in which the heat source unit 2 and the utilization unit 4 have the same specifications and the same amount of refrigerant is sealed. Note that, here, it is assumed that the connection pipe length of the air conditioner A is assumed to be shorter than the reference value, and the connection pipe length of the air conditioner B is longer than the reference value.

In this case, an amount of surplus refrigerant of the air conditioner B is relatively small. Therefore, even if the target value of the degree of subcooling used during the detection operation is the same as that during the normal operation, if the refrigerant is leaking from the refrigerant circuit 10, a value of the discharge temperature or the degree of discharge superheating or a value of the degree of suction superheating for use in determination of refrigerant leakage is likely to change.

Whereas, the air conditioner A has more surplus refrigerant than the air conditioner B. Therefore, in the air conditioner A, when a target value of the degree of subcooling for use at the time of the detection operation is the same as that at the time of the normal operation, a relatively large amount of refrigerant is likely to be present in pipes or the like between the expansion valves 25, 26 and the suction side of the compressor 21. Therefore, even if some refrigerant is leaking from the refrigerant circuit 10, there is no significant change in the value of the discharge temperature or the degree of discharge superheating or the value of the degree of suction superheating for use in determination of refrigerant leakage, and it is difficult to detect refrigerant leakage at an early stage. On the other hand, in the air conditioner A, by setting the target value of the degree of subcooling used during the detection operation to a value larger than that during the normal operation, an amount of refrigerant present between the discharge side of the compressor 21 and the expansion valves 25, 26 can be increased, and the amount of refrigerant present in pipes or the like between the expansion valves 25, 26 and the suction side of the compressor 21 can be reduced. Therefore, if the refrigerant is leaking from the refrigerant circuit 10, the values of the degree of discharge superheating or the degree of suction superheating for use in determination of refrigerant leakage are likely to change, and refrigerant leakage detection at a relatively early stage is likely to be achieved.

Therefore, here, the degree of subcooling is adjusted to a value larger than the target value during the normal operation when the first detection operation is performed, in other words, when the connection pipe length is shorter than the reference value. Note that the reference value may be determined by considering how short of the connection pipe length is likely to lead to a delay in detection of refrigerant leakage, through, for example, theoretical calculation, an experiment using a test machine, or a simulation on a computer.

Figure 6:
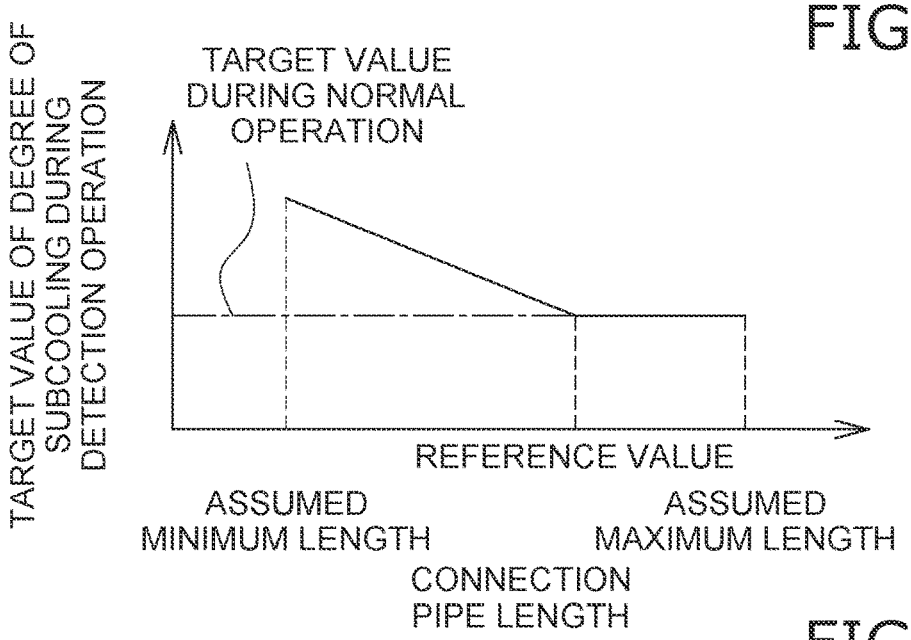
FIG. 6 is a graph conceptually illustrating an example of a relationship between a connection pipe length and a target value of a degree of subcooling during the detection operation.
Figure 7:
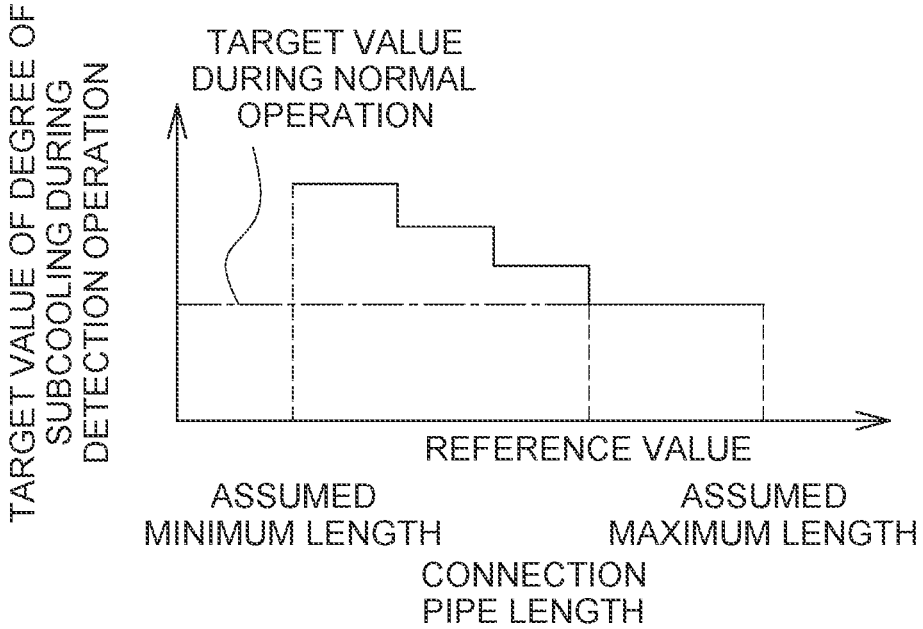
FIG. 7 is a graph conceptually illustrating another example of a relationship between a connection pipe length and a target value of a degree of subcooling during the detection operation.

Note that the third target value may be a single value larger than the first target value. Preferably, the third target value is a value that is larger than the first target value and is determined according to the connection pipe length. Specifically, the third target value is a value that is larger than the first target value, and is larger as the connection pipe length is shorter. Note that, as illustrated in FIG. 6, the third target value may be continuously changed in accordance with a change in the connection pipe length. Further, as illustrated in FIG. 7, the third target value may be changed stepwise for each range of the connection pipe length.

The controller 51 determines the third target value for use in determination of refrigerant leakage by the following method, for example.

The storage unit 53 stores a connection pipe length or a length range of the connection pipe length and the third target value corresponding to the connection pipe length or the length range of the connection pipe length, in association with each other. The controller 51 calls, from the storage unit 53, the third target value corresponding to the connection pipe length or the length range of the connection pipe length corresponding to the connection pipe length information stored in the storage unit 53, to determine the third target value of the degree of subcooling during the first detection operation.

Alternatively, the storage unit 53 may store a calculation formula for calculating the third target value from the connection pipe length. The controller 51 substitutes the connection pipe length as the connection pipe length information stored in the storage unit 53 into the calculation formula stored in the storage unit 53, to calculate the third target value of the degree of subcooling during the first detection operation.

Note that the third target value corresponding to the connection pipe length or the length range of the connection pipe length or the calculation formula for calculating the third target value from the connection pipe length may be determined, for example, by theoretical calculation, an experiment using a test machine, or a simulation on a computer.

Similarly to the third target value, the fourth target value may be a single value larger than the second target value. Preferably, the fourth target value is a value that is larger than the second target value and is determined according to the connection pipe length. Specifically, the fourth target value is a value that is larger than the second target value, and is larger as the connection pipe length is shorter. Note that, as illustrated in FIG. 6, the fourth target value may be continuously changed in accordance with a change in the connection pipe length. Further, as illustrated in FIG. 7, the fourth target value may be changed stepwise for each range of the connection pipe length. The determination of the fourth target value may be performed by a method similar to the determination of the third target value. Detailed descriptions will be omitted.

Next, in step S6, the controller 51 determines a number of rotations of the compressor at the time of performing the detection operation. When executing the first detection operation and the second detection operation, the controller 51 preferably adjusts a number of rotations of the compressor 21 to a first number of rotations R1, which is equal to or smaller than a median value ((Rmax+Rmin)/2) of the range of number of rotations between the maximum number of rotations Rmax and the minimum number of rotations Rmin.

Note that the reason for adjusting the number of rotations of the compressor 21 to the relatively small first number of rotations R1 is to increase an amount of refrigerant present between the discharge side of the compressor 21 and the expansion valves 25, 26 and to reduce the amount of refrigerant present in pipes or the like between the expansion valves 25, 26 and the suction side of the compressor 21, by reducing the number of rotations of the compressor 21. By reducing the amount of refrigerant present in the pipes or the like between the expansion valves 25, 26 and the suction side of the compressor 21, the values of the degree of discharge superheating or the degree of suction superheating for use in determination of refrigerant leakage are likely to change, and refrigerant leakage detection at a relatively early stage is likely to be achieved.

The first number of rotations R1 may be a single value equal to or smaller than the median value ((Rmax+Rmin)/2) of the range of number of rotations between the maximum number of rotations Rmax and the minimum number of rotations Rmin. In a case where the first number of rotations R1 is a single value, the controller 51 uses the first number of rotations R1 stored in advance in the storage unit 53. For example, the first number of rotations R1 may be the minimum number of rotations Rmin stored in advance in the storage unit 53.

Figure 8:
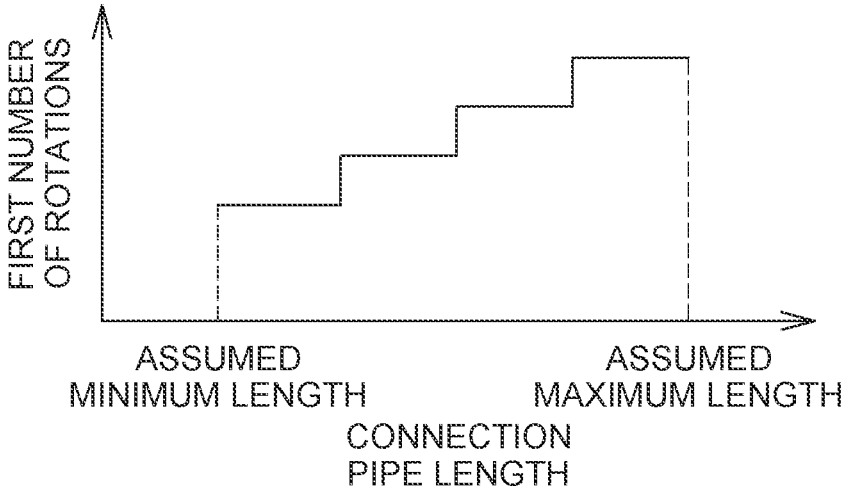
FIG. 8 is a graph conceptually illustrating an example of a relationship between a connection pipe length and a first number of rotations of a compressor during the detection operation.

Preferably, the first number of rotations R1 is equal to or smaller than the median value ((Rmax+Rmin)/2) of the range of number of rotations between the maximum number of rotations Rmax and the minimum number of rotations Rmin, and is a value determined according to the connection pipe length (a smaller value as the connection pipe length is shorter). For example, the first number of rotations R1 is changed stepwise for each range of the connection pipe length as illustrated in FIG. 8.

The controller 51 determines the first number of rotations R1 for use in determination of refrigerant leakage, by the following method, for example. The storage unit 53 stores a connection pipe length or a length range of the connection pipe length and the first number of rotations R1 corresponding to the connection pipe length and the length range of the connection pipe length, in association with each other. The controller 51 calls, from the storage unit 53, the first number of rotations R1 corresponding to the connection pipe length or the length range of the connection pipe length corresponding to the connection pipe length information stored in the storage unit 53, to determine the first number of rotations R1 during the detection operation.

Note that, the first number of rotations R1 corresponding to the connection pipe length or the length range of the connection pipe length may be determined by, for example, theoretical calculation, an experiment using a test machine, or a simulation on a computer.

When the target value of the degree of subcooling during the detection operation is determined in step S3 or step S5, and the first number of rotations R1 is determined in step S6, the controller 51 starts the detection operation by using the determined target value of the degree of subcooling and the first number of rotations R1 as operating conditions (step S7).

A specific example of control of the operation of the air conditioner 100 by the controller 51 during the detection operation will be described. Note that, as described above, during the detection operation, the controller 51 may set the state of the refrigerant circuit 10 to the first state, or may set the state of the refrigerant circuit 10 to the second state. Here, a control content of the air conditioner 100 by the controller 51 will be described by taking, as an example, a case where the controller 51 sets the state of the refrigerant circuit 10 to the first state during the detection operation.

The controller 51 controls an operation of the flow path switching mechanism 22 such that the flow direction of the refrigerant in the refrigerant circuit 10 is set to the first flow direction D1, and then activates the compressor 21, the first fan 27, and the second fan 42. Then, the controller 51 controls an opening degree of the first expansion valve 25 such that a degree of subcooling is adjusted to a predetermined third target value. The degree of subcooling is calculated, for example, by subtracting a measurement value of the second temperature sensor 34 from a measurement value of the first temperature sensor 33. In addition, the controller 51 controls a number of rotations of the compressor 21 to the first number of rotations R1.

Note that the controller 51 preferably increases an opening degree of an expansion valve on the evaporator side among the two expansion valves 25 and 26 (step S8). Here, since the flow direction of the refrigerant in the refrigerant circuit 10 is the first flow direction D1, the controller 51 increases the opening degree of the second expansion valve 26. The controller 51 may set the opening degree of the second expansion valve 26 to the maximum opening degree, or may control the opening degree to a predetermined opening degree or more that is smaller than the maximum opening degree. Here, the reason for increasing the opening degree of the expansion valve of the expansion mechanism on the evaporator side is to cause the refrigerant inside the receiver 24 to flow out to reduce an amount of refrigerant present in pipes or the like between the first expansion valve 25 and the suction side of the compressor 21, and cause a change to easily occur in a value of the discharge temperature or the degree of discharge superheating or a value of the degree of suction superheating for use in determination of refrigerant leakage, to achieve refrigerant leakage detection at a relatively early stage.

Note that, although not described in detail, when the flow direction of the refrigerant in the refrigerant circuit 10 during the detection operation is the second flow direction D2, the controller 51 increases the opening degree of the first expansion valve 25 in step S8.

In step S9, the controller 51 determines whether a predetermined time has elapsed since the start of the detection operation. When it is determined that the predetermined time has elapsed, the process proceeds to step S10. The process of step S9 is repeated until it is determined that the predetermined time has elapsed.

In step S10, the controller 51 detects a discharge temperature (or a degree of discharge superheating) or a degree of suction superheating from measurement values of the sensors at the time of execution of step S10. Note that, in a case where both the discharge temperature (or the degree of discharge superheating) and the degree of suction superheating are used to determine refrigerant leakage, the controller 51 may detect the discharge temperature (or the degree of discharge superheating) and the degree of suction superheating from measurement values of the sensors at the time of execution of step S10. Since a specific detection method of the discharge temperature (or the degree of discharge superheating) or the degree of suction superheating has already been described, the description thereof is omitted here.

In step S11, the controller 51 determines whether or not the refrigerant is leaking from the refrigerant circuit 10 on the basis of, for example, a comparison result between the detected discharge temperature (or degree of discharge superheating) and the first threshold value. Specifically, the controller 51 determines that the refrigerant is leaking from the refrigerant circuit 10 when the discharge temperature (or the degree of discharge superheating) is equal to or higher than the first threshold value, and determines that the refrigerant is not leaking from the refrigerant circuit 10 when the discharge temperature (or the degree of discharge superheating) is lower than the first threshold value.

Alternatively, in step S11, the controller 51 may determine whether or not the refrigerant is leaking from the refrigerant circuit 10 on the basis of a comparison result between the detected degree of suction superheating and the second threshold value. Specifically, the controller 51 determines that the refrigerant is leaking from the refrigerant circuit 10 when the degree of suction superheating is equal to or larger than the second threshold value, and determines that the refrigerant is not leaking from the refrigerant circuit 10 when the degree of suction superheating is smaller than the second threshold value.

Further, the controller 51 may determine whether or not the refrigerant is leaking from the refrigerant circuit 10 on the basis of both the degree of discharge superheating and the degree of suction superheating.

When the controller 51 determines in step S11 that the refrigerant is leaking from the refrigerant circuit 10, the controlling unit 50 reports, via the network NW, that the refrigerant is leaking from the refrigerant circuit 10 (refrigerant leakage) to the monitoring apparatus 200 (step S12). Note that the controlling unit 50 may not only report that the refrigerant is leaking from the refrigerant circuit 10 to the monitoring apparatus 200, but may also notify a user of the air conditioner 100 that the refrigerant is leaking from the refrigerant circuit 10. For example, the controlling unit 50 may notify a display unit (not illustrated) or the like of the remote controller 60 that the refrigerant is leaking from the refrigerant circuit 10.

In a case where the controller 51 determines in step S11 that the refrigerant is not leaking from the refrigerant circuit 10, the controlling unit 50 reports, via the network NW, that the refrigerant is not leaking from the refrigerant circuit 10 (no refrigerant leakage) to the monitoring apparatus 200 (step S12). Note that, the controlling unit 50 may not only report that the refrigerant is not leaking from the refrigerant circuit 10 to the monitoring apparatus 200, but may report also to the user of the air conditioner 100 that the refrigerant is not leaking from the refrigerant circuit 10. For example, the controlling unit 50 may notify a display unit (not illustrated) or the like of the remote controller 60 that the refrigerant is not leaking from the refrigerant circuit 10.

(4) Features (4-1)

The air conditioner 100 includes the heat source unit 2, the utilization unit 4, and the connection pipe connecting the heat source unit 2 and the utilization unit 4. The connection pipe includes the liquid refrigerant connection pipe 6 and the gas refrigerant connection pipe 8. The air conditioner 100 includes the refrigerant circuit 10 through which a refrigerant circulates, the sensor that detects a state of the refrigerant in the refrigerant circuit 10, and the controller 51. The refrigerant circuit 10 is formed by connecting, via a refrigerant pipe, the compressor 21, the condenser, the first expansion valve 25 as an expansion mechanism, the second expansion valve 26, and the evaporator. When the refrigerant circuit 10 is in the first state, the first heat exchanger 23 functions as a condenser, and the second heat exchanger 41 functions as an evaporator. When the refrigerant circuit 10 is in the second state, the second heat exchanger 41 functions as a condenser, and the first heat exchanger 23 functions as an evaporator. The sensors include, for example, the suction temperature sensor 31, the discharge temperature sensor 32, the first temperature sensor 33, and the fourth temperature sensor 44. The controller 51 executes the normal operation according to an air conditioning load and the first detection operation of detecting refrigerant leakage. In the present embodiment, the normal operation includes the cooling operation and the heating operation. When executing the cooling operation, the controller 51 adjusts a degree of subcooling at the outlet of the condenser to the first target value. When executing the heating operation, the controller 51 adjusts a degree of subcooling at the outlet of the condenser to the second target value. The controller 51 detects a value related to a discharge temperature of the compressor 21 or a value related to a degree of superheating at the outlet of the evaporator, on the basis of a detection result of the sensor that detects a state of the refrigerant in the refrigerant circuit 10. Specifically, the controller 51 detects a discharge temperature (or a degree of discharge superheating) as the value related to a discharge temperature of the compressor 21 or a degree of suction superheating as the value related to a degree of superheating at the outlet of the evaporator, on the basis of a detection result of the sensor that detects a state of the refrigerant in the refrigerant circuit 10.

When executing the first detection operation with the refrigerant circuit 10 brought into the first state, the controlling unit 50 adjusts the degree of subcooling to the third target value larger than the first target value, and determines that the refrigerant is leaking from the refrigerant circuit 10 when the discharge temperature (or the degree of discharge superheating) is equal to or higher than the first threshold value, or when the degree of suction superheating is equal to or higher than the second threshold value.

When executing the first detection operation with the refrigerant circuit 10 brought into the second state, the controlling unit 50 adjusts the degree of subcooling to the fourth target value larger than the second target value, and determines that the refrigerant is leaking from the refrigerant circuit 10 when the discharge temperature (or the degree of discharge superheating) is equal to or higher than the first threshold value, or when the degree of suction superheating is equal to or higher than the second threshold value.

During the first detection operation, the air conditioner 100 controls the degree of subcooling to a value larger than that in the normal operation. Therefore, even when an amount of a charged refrigerant is relatively large with respect to the volume of the refrigerant circuit 10, the air conditioner 100 can bring the refrigerant circuit 10 into a state where refrigerant leakage is easily detected on the basis of the value related to the discharge temperature of the compressor 21 and the value related to the degree of superheating at the outlet of the evaporator. As a result, the air conditioner 100 can accurately detect refrigerant leakage at a relatively early stage.

(4-2)

In the air conditioner 100, when executing the detection operation, the controller 51 adjusts a number of rotations of the compressor 21 to the first number of rotations R1, which is equal to or smaller than the median value ((Rmax+Rmin)/2) of the range of number of rotations between the maximum number of rotations Rmax and the minimum number of rotations Rmin of the compressor 21.

The air conditioner 100 controls the number of rotations of the compressor 21 to a relatively small value during the detection operation. Therefore, even when an amount of a charged refrigerant is relatively large with respect to the volume of the refrigerant circuit 10, the air conditioner 100 can bring the refrigerant circuit 10 into a state where refrigerant leakage is easily detected on the basis of the value related to the discharge temperature of the compressor 21 and the value related to the degree of superheating at the outlet of the evaporator. As a result, the air conditioner 100 can accurately detect refrigerant leakage at a relatively early stage.

(4-3)

In the air conditioner 100, the first number of rotations R1 is determined according to the connection pipe length. As a result, the air conditioner 100 can improve detection accuracy of refrigerant leakage as described above.

(4-4)

In the air conditioner 100, the third target value or the fourth target value, which is the target value of the degree of subcooling when the first detection operation is executed, is determined according to the connection pipe length. As a result, the air conditioner 100 can improve detection accuracy of refrigerant leakage as described above.

(4-5)

In the air conditioner 100, the first threshold value or the second threshold value for use in the refrigerant leakage determination value is determined according to the connection pipe length. As a result, the air conditioner 100 can improve detection accuracy of refrigerant leakage as described above.

(4-6)

In the air conditioner 100, the controller 51 receives information regarding the length of the connection pipe (connection pipe length information). As a result, the air conditioner 100 can appropriately set an operating condition of the first detection operation and the threshold value for refrigerant leakage detection in accordance with actual lengths of the liquid refrigerant connection pipe 6 and the gas refrigerant connection pipe 8.

(4-7)

In the air conditioner 100, the controller 51 executes the second detection operation of detecting refrigerant leakage, when the connection pipe length is equal to or longer than the reference value. When executing the second detection operation, the controller 51 adjusts a degree of subcooling to the same target value as that during the normal operation, and determines that the refrigerant is leaking from the refrigerant circuit when the value related to the discharge temperature of the compressor 21 or the value related to the degree of superheating at the outlet of the evaporator is equal to or larger than the threshold value.

The air conditioner 100 can prevent a failure in which a state without refrigerant leakage is determined as a refrigerant leakage state, which is caused due to the degree of subcooling during the detection operation being excessively increased in a case where an amount of a charged refrigerant is relatively small with respect to the volume of the refrigerant circuit 10.

(4-8)

In the air conditioner 100, the refrigerant circuit 10 includes the receiver 24 disposed between the condenser and the evaporator. The expansion mechanism of the air conditioner 100 includes the first valve disposed between the condenser and the container and the second valve disposed between the container and the evaporator. When the refrigerant circuit 10 is in the first state, the first expansion valve 25 is the first valve, and the second expansion valve 26 is the second valve. When the refrigerant circuit 10 is in the second state, the first expansion valve 25 is the second valve, and the second expansion valve 26 is the first valve. The controller 51 increases an opening degree of the second valve during the first detection operation.

The air conditioner 100 can cause the refrigerant in the receiver 24 to flow out of the container, and can collect the refrigerant on a high-pressure side of the refrigerant circuit 10, during the detection operation. Therefore, the air conditioner 100 can bring the refrigerant circuit 10 into a state where refrigerant leakage is easily detected on the basis of the value related to the discharge temperature of the compressor or the value related to the degree of superheating at the outlet of the evaporator.

(4-9)

The air conditioner 100 is a chargeless air conditioner in which the refrigerant is not additionally charged into the refrigerant circuit 10 at the installation site of the air conditioner 100.

In the chargeless air conditioner in which the refrigerant is not additionally charged into the refrigerant circuit 10 at the installation site of the air conditioner 100, a length of the connection pipe constructed on site is assumed, and an amount of refrigerant that does not cause shortage of an amount of refrigerant even if the connection pipe having the assumed length is used is charged in advance. However, the length of the connection pipe constructed on site may be shorter than the assumed maximum length, and the amount of a charged refrigerant with respect to a unit volume of the refrigerant circuit 10 may vary depending on the installation site.

This air conditioner 100 controls, during the first detection operation, the degree of subcooling to a value larger than that in the normal operation. Therefore, even when an amount of a charged refrigerant is relatively large with respect to the volume of the refrigerant circuit 10, the air conditioner 100 can bring the refrigerant circuit 10 into a state where refrigerant leakage is easily detected on the basis of the value related to the discharge temperature of the compressor 21 or the value related to the degree of superheating at the outlet of the evaporator.

(5) Modifications

Modifications of the above embodiment will be described. Note that the configurations of the individual modifications described below may be combined with some or all of the configurations of other modifications as long as there is no contradiction.

(5-1) Modification A

The air conditioner 100 according to the above embodiment includes the first detection operation and the second detection operation as the detection operation, but the present disclosure is not limited thereto. The air conditioner 100 may perform only the first detection operation using a value larger than a target value of a degree of subcooling during the normal operation, as the target value of the degree of subcooling. In this case, the processes of steps S1 to S4 may be omitted from the flowchart of FIG. 3, and the controller 51 may start the process from step S4.

(5-2) Modification B

In the above embodiment, the first threshold value and the second threshold value are determined according to the connection pipe length, but the present disclosure is not limited thereto, and the first threshold value and the second threshold value may be the same value regardless of the connection pipe length.

(5-3) Modification C

In the above embodiment, in both of a case where the detection operation is performed with the state of the refrigerant circuit 10 set to the first state, and a case where the detection operation is performed with the state of the refrigerant circuit 10 set to the second state, the same values are assumed to be used as the first threshold value, the second threshold value, and the first number of rotations R1. However, the present disclosure is not limited thereto, and different values may be used for the first threshold value, the second threshold value, and the first number of rotations R1 between the case where the detection operation is performed with the state of the refrigerant circuit 10 set to the first state and the case where the detection operation is performed with the state of the refrigerant circuit 10 set to the second state.

(5-4) Modification D

In the above embodiment, the case where the air conditioner 100 includes the receiver 24 has been described as an example, but the present disclosure is not limited thereto.

Figure 9:
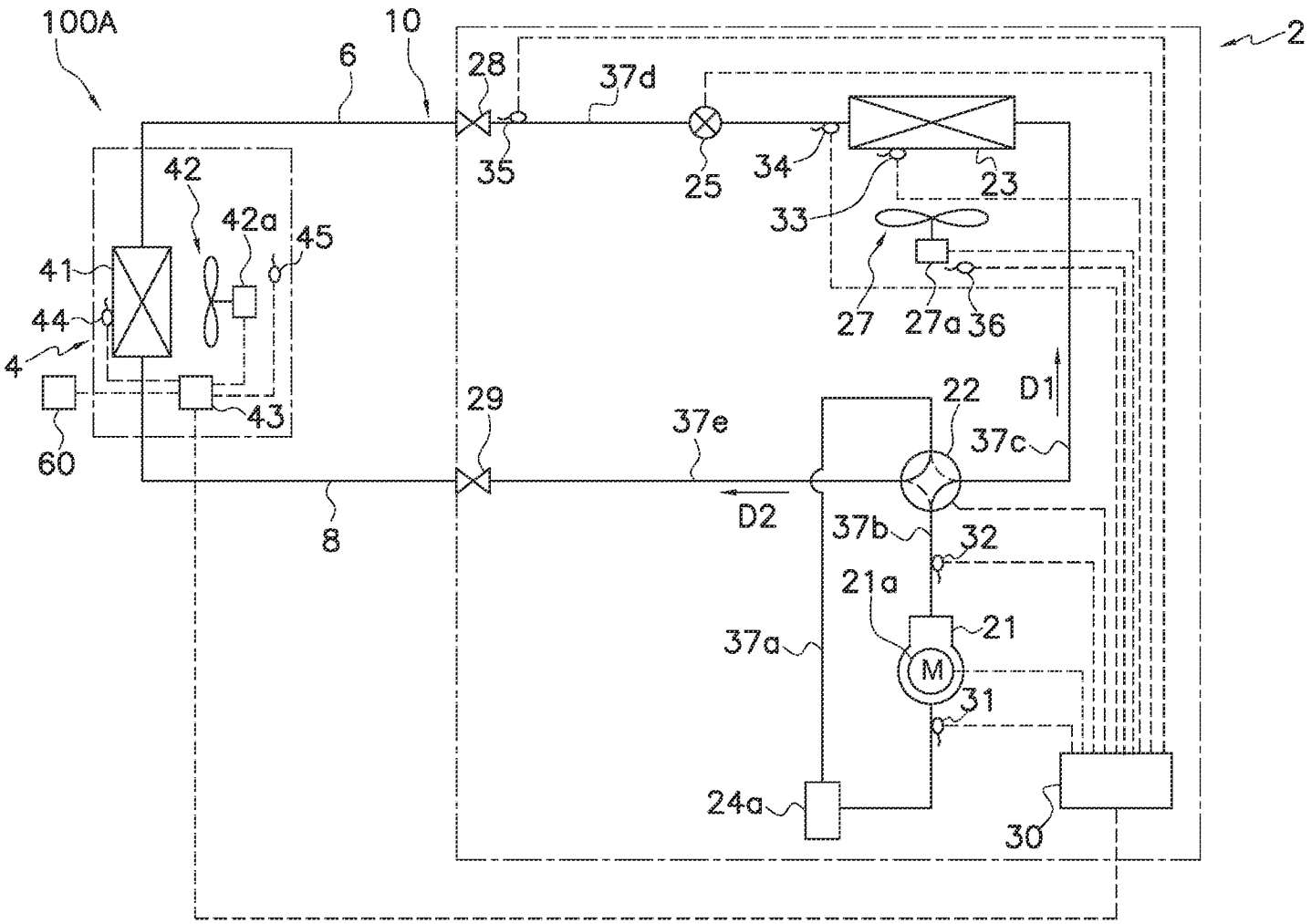
FIG. 9 is a schematic configuration diagram of another example of an air conditioner that is an example of a refrigeration cycle apparatus.

For example, the refrigeration cycle apparatus of the present disclosure may be an apparatus that does not include the receiver 24 and the second expansion valve 26 but includes an accumulator 24*a* in the suction pipe 37*a*, for example, as in an air conditioner 100A illustrated in FIG. 9. In the air conditioner 100A, the controller 51 controls an opening degree of the first expansion valve 25 such that the degree of subcooling is adjusted to the first target value during the cooling operation and the degree of subcooling is adjusted to the second target value during the heating operation. Then, also in the air conditioner 100A, the controller 51 performs the first detection operation as described above in which the degree of subcooling is set to a target value larger than that during the normal operation. As a result, even when an amount of a charged refrigerant is relatively large with respect to the volume of the refrigerant circuit 10, the refrigerant circuit 10 can be brought into a state where refrigerant leakage is easily detected on the basis of the value related to the discharge temperature of the compressor 21 or the value related to the degree of superheating at the outlet of the evaporator. Note that, although detailed description is omitted, the configuration of the air conditioner 100 may be appropriately adopted for the air conditioner 100A as long as there is no contradiction.

(5-5) Modification E

In the above embodiment, the case where the air conditioner 100 is a chargeless air conditioner has been described, but the refrigeration cycle apparatus of the present disclosure is not limited to a chargeless refrigeration cycle apparatus.

Also in a refrigeration cycle apparatus in which the refrigerant is additionally charged at the installation site, usually, the refrigerant circuit is not charged with a minimum required amount of refrigerant but is charged with a larger amount of refrigerant than the minimum required amount. In other words, even in the refrigeration cycle apparatus in which the refrigerant is additionally charged at the installation site, the refrigerant circuit of the refrigeration cycle apparatus is charged with the surplus refrigerant. In case where the amount of such a surplus refrigerant is large, when the detection operation is performed by using the same target value of the degree of subcooling as that in the normal operation, it may be difficult to detect refrigerant leakage at an early stage. On the other hand, by performing the first detection operation in which the target value of the degree of subcooling is made larger than that in the normal operation, detection accuracy of refrigerant leakage can be improved, and refrigerant leakage can be detected at an early stage.

(5-6) Modification F

In the air conditioner 100 of the above embodiment, the third target value and the fourth target value of the degree of subcooling, the first number of rotations R1, the first threshold value, and the second threshold value are determined according to the connection pipe length, but the present disclosure is not limited thereto.

For example, in the air conditioner 100, the third target value and the fourth target value of the degree of subcooling, the first number of rotations R1, the first threshold value, and the second threshold value may be determined according to an internal volume of the refrigerant circuit 10. For example, in the chargeless air conditioner 100 of the above embodiment, as the internal volume of the refrigerant circuit 10 is smaller, the third target value and the fourth target value of the degree of subcooling are determined to be larger, the first number of rotations R1 is determined to be smaller, and the first threshold value and the second threshold value are determined to be smaller.

Note that, in such a configuration, the controller 51 may receive information regarding the internal volume of the connection pipe instead of the connection pipe length information. Further, in addition to the connection pipe length information and the information regarding the internal volume of the connection pipe, the controller 51 may receive information regarding internal volumes of the first heat exchanger 23 and the second heat exchanger 41. Alternatively, the information regarding the internal volumes of the first heat exchanger 23 and the second heat exchanger 41 and the like may be stored in the storage unit 53 in advance.

<Supplementary Note>

The embodiment of the present disclosure has been described above. It will be understood that various changes to modes and details can be made without departing from the spirit and scope of the present disclosure recited in the claims.

REFERENCE SIGNS LIST

2: heat source unit
4: utilization unit
6: liquid refrigerant connection pipe (connection pipe)
8: gas refrigerant connection pipe (connection pipe)
10: refrigerant circuit
21: compressor
23: first heat exchanger (condenser, evaporator)
24: receiver (container)
25: first expansion valve (expansion mechanism, first valve)
26: second expansion valve (expansion mechanism, second valve)
31: suction temperature sensor (sensor)
32: discharge temperature sensor (sensor)
33: first temperature sensor (sensor)
44: fourth temperature sensor (sensor)
41: second heat exchanger (evaporator, condenser)
51: controller
100: refrigeration cycle apparatus

CITATION LIST

Patent Literature

Patent Literature 1: JP 2006-23072 A

The invention claimed is:

1. A refrigeration cycle apparatus comprising: a heat source unit; a utilization unit; and a connection pipe that connects the heat source unit and the utilization unit, the refrigeration cycle apparatus comprising:

a refrigerant circuit through which a refrigerant being configured to circulate, the refrigerant circuit being formed by connecting, via a refrigerant pipe, a compressor, a condenser, an expansion mechanism, and an evaporator;

a sensor configured to measure an amount representing a state of the refrigerant in the refrigerant circuit; and a controller, the controller being configured to execute a normal operation according to an air conditioning load and a first detection operation of detecting refrigerant leakage, the controller being configured to adjust a degree of subcooling at an outlet of the condenser to a first value when executing the normal operation, the controller being configured to detect a value related to a discharge temperature of the compressor or a value related to a degree of superheating at an outlet of the evaporator, based on a measurement result of the sensor, and the controller being configured to adjust the degree of subcooling to a second value larger than the first value when executing the first detection operation, and determine that the refrigerant is leaking from the refrigerant circuit when the value related to the discharge temperature of the compressor or the value related to the degree of superheating at the outlet of the evaporator is equal to or larger than a threshold value.

2. The refrigeration cycle apparatus according to claim 1, wherein when executing the first detection operation, the controller is configured to adjust a number of rotations of the compressor to a first number of rotations equal to or smaller than a median value of a range of number of rotations between a maximum number of rotations and a minimum number of rotations of the compressor.

3. The refrigeration cycle apparatus according to claim 2, wherein the first number of rotations is determined according to a length of the connection pipe.

4. The refrigeration cycle apparatus according to claim 1, wherein the second value is determined according to a length of the connection pipe.

5. The refrigeration cycle apparatus according to claim 1, wherein the threshold value is determined according to a length of the connection pipe.

6. The refrigeration cycle apparatus according to claim 3, wherein the controller is configured to receive information regarding the length of the connection pipe.

7. The refrigeration cycle apparatus according to claim 3, wherein the controller is configured to execute a second detection operation of detecting refrigerant leakage when the length of the connection pipe is equal to or longer than a predetermined length, and when executing the second detection operation, the controller is configured to adjust the degree of subcooling to the first value, and determine that the refrigerant is leaking from the refrigerant circuit when the value related to the discharge temperature of the compressor or the value related to the degree of superheating at the outlet of the evaporator is equal to or larger than the threshold value.

8. The refrigeration cycle apparatus according to claim 1, wherein the refrigerant circuit further includes a container disposed between the condenser and the evaporator, the expansion mechanism includes a first valve disposed between the condenser and the container, and a second valve disposed between the container and the evaporator, and the controller is configured to increase an opening degree of the second valve during the first detection operation.

9. The refrigeration cycle apparatus according to claim 1, wherein the refrigerant is not additionally charged into the refrigerant circuit at an installation site of the refrigeration cycle apparatus.

10. The refrigeration cycle apparatus according to claim 2, wherein the second value is determined according to a length of the connection pipe.

11. The refrigeration cycle apparatus according to claim 3, wherein the second value is determined according to a length of the connection pipe.

12. The refrigeration cycle apparatus according to claim 2, wherein the threshold value is determined according to a length of the connection pipe.

13. The refrigeration cycle apparatus according to claim 3, wherein the threshold value is determined according to a length of the connection pipe.

14. The refrigeration cycle apparatus according to claim 4, wherein the threshold value is determined according to a length of the connection pipe.

15. The refrigeration cycle apparatus according to claim 4, wherein the controller is configured to receive information regarding the length of the connection pipe.

16. The refrigeration cycle apparatus according to claim 5, wherein the controller is configured to receive information regarding the length of the connection pipe.

17. The refrigeration cycle apparatus according to claim 4, wherein the controller is configured to execute a second detection operation of detecting refrigerant leakage when the length of the connection pipe is equal to or longer than a predetermined length, and when executing the second detection operation, the controller is configured to adjust the degree of subcooling to the first value, and determine that the refrigerant is leaking from the refrigerant circuit when the value related to the discharge temperature of the compressor or the value related to the degree of superheating at the outlet of the evaporator is equal to or larger than the threshold value.

18. The refrigeration cycle apparatus according to claim 5, wherein the controller is configured to execute a second detection operation of detecting refrigerant leakage when the length of the connection pipe is equal to or longer than a predetermined length, and when executing the second detection operation, the controller is configured to adjust the degree of subcooling to the first value, and determine that the refrigerant is leaking from the refrigerant circuit when the value related to the discharge temperature of the compressor or the value related to the degree of superheating at the outlet of the evaporator is equal to or larger than the threshold value.

19. The refrigeration cycle apparatus according to claim 6, wherein the controller is configured to execute a second detection operation of detecting refrigerant leakage when the length of the connection pipe is equal to or longer than a predetermined length, and when executing the second detection operation, the controller is configured to adjust the degree of subcooling to the first value, and determine that the refrigerant is leaking from the refrigerant circuit when the value related to the discharge temperature of the compressor or the value related to the degree of superheating at the outlet of the evaporator is equal to or larger than the threshold value.

20. The refrigeration cycle apparatus according to claim 2, wherein the refrigerant circuit further includes a container disposed between the condenser and the evaporator, the expansion mechanism includes a first valve disposed between the condenser and the container, and a second valve disposed between the container and the evaporator, and the controller is configured to increase an opening degree of the second valve during the first detection operation.

* * * * *